US008421716B2

(12) United States Patent
Numao

(10) Patent No.: US 8,421,716 B2
(45) Date of Patent: Apr. 16, 2013

(54) DISPLAY DEVICE

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1111 days.

(21) Appl. No.: 12/227,309

(22) PCT Filed: May 7, 2007

(86) PCT No.: PCT/JP2007/059445

§ 371 (c)(1),
(2), (4) Date: Nov. 13, 2008

(87) PCT Pub. No.: WO2008/026350

PCT Pub. Date: Mar. 6, 2008

(65) Prior Publication Data

US 2009/0141204 A1 Jun. 4, 2009

(30) Foreign Application Priority Data

Aug. 30, 2006 (JP) ..... 2006-234205

(51) Int. Cl.
*G09G 3/36* (2006.01)

(52) U.S. Cl.
USPC ..... 345/76; 345/77; 345/78; 345/87; 345/94; 345/95; 315/169.1; 315/169.3

(58) Field of Classification Search ..... 345/76–83, 345/204, 76–10, 690; 315/169.1–169.3; 349/41, 42
See application file for complete search history.

(56) References Cited

U.S. PATENT DOCUMENTS

| | | | | |
|---|---|---|---|---|
| 5,903,248 | A * | 5/1999 | Irwin | 345/90 |
| 6,262,704 | B1 | 7/2001 | Kurumisawa et al. | |
| 6,937,222 | B2 * | 8/2005 | Numao | 345/98 |
| 7,205,966 | B2 * | 4/2007 | Numao | 345/76 |
| 7,317,435 | B2 * | 1/2008 | Hsueh | 345/82 |
| 7,511,708 | B2 * | 3/2009 | Numao | 345/204 |
| 7,800,564 | B2 * | 9/2010 | Numao | 345/82 |
| 7,907,136 | B2 * | 3/2011 | Kobayashi | 345/208 |
| 8,044,893 | B2 * | 10/2011 | Nathan et al. | 345/76 |

(Continued)

FOREIGN PATENT DOCUMENTS

| | | |
|---|---|---|
| JP | 05-094154 | 4/1993 |
| JP | 05-143021 | 6/1993 |

(Continued)

*Primary Examiner* — Quan-Zhen Wang
*Assistant Examiner* — Jennifer Nguyen
(74) *Attorney, Agent, or Firm* — Harness, Dickey & Pierce, P.L.C.

(57) ABSTRACT

During first period, TFTs: Q1 and Q2 are set in ON and OFF states, respectively. Potential Va is fed into a source line Sj so that potential of pixel electrode is Va. During second period, the TFTs: Q1 and Q2 are set in the OFF and ON states, respectively. The potential Va is continuously fed into the source line Sj. This sets potential of node to Va, thereby changing the potential of the pixel electrode. During third period, the TFTs: Q1 and Q2 are set in the OFF state. This realizes a display device where high cost factors and power consumption increase are suppressed, and the effective value of voltage expressed by difference between potential applied to a driving potential input terminal and reference potential can have variance larger than amplitude of signal voltage fed into a data signal line, the variance corresponding to variation in the signal voltage.

12 Claims, 22 Drawing Sheets

U.S. PATENT DOCUMENTS

| | | | |
|---|---|---|---|
| 2002/0005843 | A1 | 1/2002 | Kurumisawa et al. |
| 2002/0008685 | A1 | 1/2002 | Ban et al. |
| 2002/0190973 | A1 | 12/2002 | Morita |
| 2004/0004566 | A1 | 1/2004 | Walton et al. |
| 2004/0125065 | A1 | 7/2004 | Park et al. |

FOREIGN PATENT DOCUMENTS

| | | |
|---|---|---|
| JP | 09-055909 | 2/1997 |
| JP | 2000-181414 | 6/2000 |
| JP | 2004-199082 | 7/2004 |

* cited by examiner

FIG. 3

| | | POTENTIAL OF SOURCE LINE Sj | POTENTIAL OF AUXILIARY CAPACITANCE LINE Ui | POTENTIAL OF COUNTER ELECTRODE com | POTENTIAL OF PIXEL ELECTRODE 14 | POTENTIAL OF NODE 15 |
|---|---|---|---|---|---|---|
| FIRST FRAME | INITIAL VALUE | 2 | 0 | −1 | 0 | 0 |
| | FIRST PERIOD | 2 | 0 | −1 | 2 | 1 |
| | SECOND PERIOD | 2 | 0 | −1 | 2.5 | 2 |
| | THIRD PERIOD | 2 | | | | |
| SECOND FRAME | FIRST PERIOD | −2 | 2 | 1 | −2 | 0.75 |
| | SECOND PERIOD | −2 | 2 | 1 | −3.375 | −2 |
| | THIRD PERIOD | −2 | | | | |
| THIRD FRAME | FIRST PERIOD | 2 | 0 | −1 | 2 | −0.3125 |
| | SECOND PERIOD | 2 | 0 | −1 | 3.15625 | 2 |
| | THIRD PERIOD | 2 | | | | |
| FOURTH FRAME | FIRST PERIOD | −2 | 2 | 1 | −2 | 0.421875 |
| | SECOND PERIOD | −2 | 2 | 1 | −3.2109375 | −2 |
| | THIRD PERIOD | −2 | | | | |
| FIFTH FRAME | FIRST PERIOD | 2 | 0 | −1 | 2 | −0.3945313 |
| | SECOND PERIOD | 2 | 0 | −1 | 3.19726563 | 2 |
| | THIRD PERIOD | 2 | | | | |
| SIXTH FRAME | FIRST PERIOD | −2 | 2 | 1 | −2 | 0.40136719 |
| | SECOND PERIOD | −2 | 2 | 1 | −3.2006836 | −2 |
| | THIRD PERIOD | −2 | | | | |
| SEVENTH FRAME | FIRST PERIOD | 2 | 0 | −1 | 2 | −0.3996582 |
| | SECOND PERIOD | 2 | 0 | −1 | 3.1998291 | 2 |
| | THIRD PERIOD | 2 | | | | |
| EIGHTH FRAME | FIRST PERIOD | −2 | 2 | 1 | −2 | 0.40008545 |
| | SECOND PERIOD | −2 | 2 | 1 | −3.2000427 | −2 |
| | THIRD PERIOD | −2 | | | | |

FIG. 4

| | | POTENTIAL OF SOURCE LINE Sj | POTENTIAL OF AUXILIARY CAPACITANCE LINE Ui | POTENTIAL OF COUNTER ELECTRODE com | POTENTIAL OF PIXEL ELECTRODE 14 | POTENTIAL OF NODE 15 |
|---|---|---|---|---|---|---|
| FIRST FRAME | INITIAL VALUE | 0 | 0 | −1 | 0 | 0 |
| | FIRST PERIOD | 0 | 0 | −1 | 0 | 0 |
| | SECOND PERIOD | 0 | 0 | −1 | 0 | 0 |
| | THIRD PERIOD | 0 | | | | |
| SECOND FRAME | FIRST PERIOD | 0 | 2 | 1 | 0 | 1 |
| | SECOND PERIOD | 0 | 2 | 1 | −0.5 | 0 |
| | THIRD PERIOD | 0 | | | | |
| THIRD FRAME | FIRST PERIOD | 0 | 0 | −1 | 0 | −0.75 |
| | SECOND PERIOD | 0 | 0 | −1 | 0.375 | 0 |
| | THIRD PERIOD | 0 | | | | |
| FOURTH FRAME | FIRST PERIOD | 0 | 2 | 1 | 0 | 0.8125 |
| | SECOND PERIOD | 0 | 2 | 1 | −0.40625 | 0 |
| | THIRD PERIOD | 0 | | | | |
| FIFTH FRAME | FIRST PERIOD | 0 | 0 | −1 | 0 | −0.796875 |
| | SECOND PERIOD | 0 | 0 | −1 | 0.3984375 | 0 |
| | THIRD PERIOD | 0 | | | | |
| SIXTH FRAME | FIRST PERIOD | 0 | 2 | 1 | 0 | 0.80078125 |
| | SECOND PERIOD | 0 | 2 | 1 | −0.4003906 | 0 |
| | THIRD PERIOD | 0 | | | | |
| SEVENTH FRAME | FIRST PERIOD | 0 | 0 | −1 | 0 | −0.7998047 |
| | SECOND PERIOD | 0 | 0 | −1 | 0.39990234 | 0 |
| | THIRD PERIOD | 0 | | | | |
| EIGHTH FRAME | FIRST PERIOD | 0 | 2 | 1 | 0 | 0.80004883 |
| | SECOND PERIOD | 0 | 2 | 1 | −0.4000244 | 0 |
| | THIRD PERIOD | 0 | | | | |

DISPLAY DEVICE

TECHNICAL FIELD

The present invention relates to a method for driving a display such as a liquid crystal display by which method the response speed of the display is improved, and to a display device using the method.

BACKGROUND ART

As liquid crystal televisions have become less expensive in recent years, they are in widespread use among average households. Also, since broadband communications have become widespread, there are more occasions on which moving images are displayed even with personal computers. In addition, since digital terrestrial broadcasting has started, there are more occasions on which moving images are displayed with portable devices such as portable phones.

In view of this, research and development have been widely conducted for improvement of the moving image quality of liquid crystal displays, and such research and development have produced many successful results.

Patent Document 1 discloses one of techniques that are attained as a result of such research and development. The technique of Patent Document 1 is for improvement of the moving image quality of liquid crystal TVs. FIGS. 17 and 18 show the technique of Patent Document 1.

FIG. 17 is a view showing an arrangement of a liquid crystal display 21 disclosed in Patent Document 1. The liquid crystal display 21 includes pixels Aij, each of which includes: a TFT:Qx; an auxiliary capacitor Cs; and a liquid crystal element LC. The TFT:Qx includes: a drain terminal connected with one terminal of the auxiliary capacitor Cs and one terminal of the liquid crystal element LC; a source terminal connected with one of source lines Xj (where j=n−1 to n+2); and a gate terminal connected with one of gate lines Yi (where i=n−1 to n+2). The other terminal of the auxiliary capacitor Cs is connected with one of auxiliary capacitance lines Ci (where j=n−1 to n+2).

The source line Xj is connected with a video signal driver 22. The gate line Yi is connected with a scanning signal driver 23. The auxiliary capacitance line Ci is connected with an auxiliary capacitor driver 24.

In addition, these lines are fed with their respective voltages shown in FIG. 18.

Specifically, the source line Xj is fed with a voltage designated by "VIDEO SIGNAL" in FIG. 18. The gate line Yi is fed with a voltage designated by "SCANNING SIGNAL" in FIG. 18. The auxiliary capacitance line Ci is fed with a voltage designated by "AUXILIARY CAPACITOR LINE SIGNAL" in FIG. 18. This causes a voltage applied to the liquid crystal element LC to be changed as indicated in "PIXEL POTENTIAL CHANGE (VOLTAGE APPLIED TO LIQUID CRYSTAL)" in FIG. 18. Specifically, the liquid crystal is fed with a voltage Vd during the first half of one horizontal period, while the voltage Vd is changed into a voltage Vd' in the second half. This causes the transmittance of the pixel to change as indicated in "LUMINANCE CHANGE" in FIG. 18.

As described above, Patent Document 1 is arranged such that a period during which the luminance of a pixel is reduced with use of an auxiliary capacitance is provided so as to improve the residual image characteristic exhibited when a moving image is displayed with a pseudo-impulse driving.

As is clear from the relationship between the applied voltages and the luminance change, the liquid crystal used in Patent Document 1 is of a normally while mode (in which the transmittance of the liquid crystal is maximal when no voltage is applied).

The following description deals with a D/A converter circuit suggested for use in liquid crystal display devices, while associating the D/A converter circuit with its production process (see, for example, Patent Documents 2 and 3).

In recent years, there have been in widespread use liquid crystal display devices including polycrystalline silicon thin film transistors (TFTs) such as polysilicon TFTs and continuous grain (CG) silicon TFTs. Particularly, with respect to mobile liquid crystal displays for use in portable phones, personal digital assistants (PDAs), and the like, efforts have been made to reduce the production costs by incorporating a gate driver circuit and a source driver circuit into a liquid crystal panel with use of polycrystalline silicon TFTs.

FIG. 19 is a block diagram showing an arrangement of a conventional liquid crystal display device including polycrystalline silicon TFTs. The display device shown in FIG. 19 includes a TFT substrate (not shown). The display device further includes, on the TFT substrate: a pixel array 80; a gate driver circuit 81; and a source driver circuit 82. The pixel array 80 includes m×n pixel circuits Aij. The gate driver circuit 81 drives gate lines G1 through Gn in accordance with a control signal C1. The source driver circuit 82 drives source lines S1 through Sm in accordance with a control signal C2 and image data DX.

The source driver circuit 82 includes: an m-bit shift register 83; an m×s-bit register 84; an m×s-bit latch 85; and m D/A converter circuits 86. The shift register 83 generates a timing pulse in accordance with the control signal C2. The register 84 sequentially stores s-bit image data DX in accordance with the timing pulse generated by the shift register 83. The m×s-bit image data stored in the register 84 is sent to the latch 85, and then, in the D/A converter circuits 86, is converted into analog voltage signals. This allows voltages corresponding to the image data DX to be fed into the pixel circuits Aij via the source lines S1 through Sm.

There are several types of D/A converter circuits for use in conventional liquid crystal display devices. Patent Document 2 describes D/A converter circuits of a capacitive division type, a resistive division type, and a pulse width modulation (PWM) type (see FIGS. 20 through 22). In a D/A converter circuit of a capacitive division type (FIG. 20), an electric charge is accumulated in each of capacitors C1 through C8 when input switches SW1, each having a terminal to which no voltage is applied, are set in an ON state. Then, when output switches SW2 are set in an ON state, the electric charge accumulated in each of the capacitors C1 through C8 is transferred to a capacitor C9. The capacitors C1 through C8 each have a capacitance which accords with a corresponding one of the respective weights ($2^w$, where w represents an integer of 0 to 7) of bits d1 through d8 of image data. The switches SW2 are individually set either in an ON state or in an OFF state in response to the bits d1 through d8 of image data.

A D/A converter circuit of a resistive division type (FIG. 21) includes a voltage divider including resistors R1 through R8 arranged in series. The voltage divider is provided with voltages VH and VL at its two ends, respectively. The resistors R1 through R8 have their respective nodes which are each connected with a switch SW3. The switches SW3 are individually set either in an ON state or in an OFF state in response to the result (output from a decoder 91) of image data decoding.

A D/A converter circuit of a PWM type (FIG. 22) includes a PWM circuit 93 which generates a pulse having a width corresponding to image data stored in a latch 92. A switch SW4 is set in an ON state while being fed with a pulse from the PWM circuit 93. One terminal of the switch SW4 is fed with a ramp wave voltage from a ramp wave power supply 94. The D/A converter circuits shown in FIGS. 20 through 22 respectively allow a voltage corresponding to image data to be fed into a source line Sj connected with an output terminal Vout.

In liquid crystal display devices in general, there exists a stray capacitance between a gate line Gi and a source line Sj (directly, or indirectly via a TFT in-between). Therefore, simply using one of the D/A converter circuits shown respectively in FIGS. 20 through 22 does not allow the voltage of a source line Sj to reach a desired level within a predetermined period of time. The D/A converter circuit of a capacitive division type shown in FIG. 20, in particular, does not allow the voltage of a source line Sj to reach a desired level regardless of the length of time. This is because only small amounts of electric charge can be accumulated in the capacitors C1 through C8. In view of this, a conventional liquid crystal display device includes, between the output terminal Vout of a D/A converter circuit 95 and a source line Sj, an analog buffer circuit 96 (having an impedance transformation ratio of 1 to 1; also called an op amp) which amplifies an output from the D/A converter circuit 95 (see FIG. 23). This analog buffer circuit is disclosed in Patent Document 3, for example.

[Patent Document 1] Japanese Unexamined Patent Application Publication Tokukai No. 2001-265287; published on Sep. 28, 2001

[Patent Document 2] Japanese Unexamined Patent Application Publication Tokukai No. 2004-199082; published on Jul. 15, 2004

[Patent Document 3] Japanese Unexamined Patent Application Publication Tokukai No. 2003-338760; published on Nov. 28, 2003

DISCLOSURE OF INVENTION

Although the driving method disclosed in Patent Document 1 allows improving the response characteristic of a liquid crystal, this driving method has a disadvantage in that the difference between an on-voltage and an off-voltage applied to a pixel (liquid crystal element) is smaller.

Specifically, according to "PIXEL POTENTIAL CHANGE (VOLTAGE APPLIED TO LIQUID CRYSTAL)" in FIG. 18, the liquid crystal is fed with a voltage Vd during the first half of one horizontal period (one frame period), while the liquid crystal is fed with a voltage Vd'=Vd+ΔVd during the second half. The transmittance of the liquid crystal element is determined by the effective value of an applied voltage. According to the driving method shown in FIG. 18, the effective value Vlc of a voltage applied to the liquid crystal element during one frame period is defined by the following equation:

$$Vlc = (Vd^2/2 + (Vd + \Delta Vd)^2/2)^{1/2} = (Vd^2 + Vd \cdot \Delta Vd + \Delta Vd^2/2)^{1/2} \quad (1)$$

Further, ΔVd is determined solely by the capacitors Cs and Clc and a change ΔVcs in an auxiliary capacitor signal, regardless of Vd.

That is, ΔVd is defined by the following equation:

$$\Delta Vd = \Delta Vcs \times Cs/(Cs+Clc)$$

where Clc represents a capacitance value of the liquid crystal element LC, and Cs represents a capacitance value of the auxiliary capacitor Cs.

For example, when ΔVcs=2V and Cs=Clc, ΔVd=1V. In this case, even when a pixel is fed with a voltage Vd(on)=0V for setting the liquid crystal in the ON state during the first half of one frame period, the effective value Vlc of the voltage for the whole frame period is in the order of 0.71V. When a pixel is fed with a voltage Vd(off)=2V for setting the liquid crystal in the OFF state during the first half of one frame period, the effective value Vlc of the voltage for the whole frame period is in the order of 2.55V.

Thus, the difference between an on-voltage and an off-voltage is defined by the following equation:

$$Vlc(\text{off}) - Vlc(\text{on}) \cong 1.84\text{V} \quad (2)$$

This is smaller than the difference between an on-voltage and an off-voltage applied when ΔVd=0V, i.e., when the voltage of an auxiliary capacitance line is fixed at a constant level during one frame period, the difference being defined by the following equation:

$$Vd(\text{off}) - Vd(\text{on}) = 2\text{V} \quad (3)$$

As described above, when the voltage of an auxiliary capacitance line is changed between the first half and the second half of one frame period, the following inequality is always satisfied:

$$Vlc(\text{off}) - Vlc(\text{on}) < Vd(\text{off}) - Vd(\text{on}) \quad (4)$$

As described above, conventional liquid crystal display devices have had a disadvantage in that, when the voltage of an auxiliary capacitance line is changed between the first half and the second half of one frame period so that a voltage applied to a liquid crystal element LC is changed within the frame period, the difference, expressed by the effective value, between an on-voltage and an off-voltage applied to the liquid crystal is smaller than the difference between an on-"VIDEO SIGNAL" voltage and an off-"VIDEO SIGNAL" voltage outputted from a video signal driver (source driver circuit). This indicates that a source driver circuit having a voltage amplitude larger than that of a voltage applied to the liquid crystal element LC is required in a case of driving an identical liquid crystal with a voltage having a constant effective value. Unfortunately, such a source driver circuit having a large voltage amplitude disadvantageously requires a higher production cost and larger power consumption.

The effective value used herein is intended to refer to the effective value of a voltage during one frame period, which voltage is expressed as the difference between (i) a potential of a pixel electrode, i.e., a potential of a driving potential input terminal into which a potential for driving the liquid crystal element LC is fed, and (ii) a reference potential, i.e., a potential of a counter electrode. In addition, a potential of the driving potential input terminal is either not smaller or not greater than the reference potential at any given time during one frame period.

When a changed voltage of an auxiliary capacitance line is maintained during one frame period, the following equation is satisfied:

$$Vlc = ((Vd + \Delta Vd)^2)^{1/2} = Vd + \Delta Vd \quad (5)$$

Accordingly, the following equation is also satisfied:

$$Vlc(\text{off}) - Vlc(\text{on}) = Vd(\text{off}) - Vd(\text{on}) \quad (6)$$

Therefore, the above problem does not occur.

The present invention has been accomplished in order to solve the above problem, and an object of the present invention is to realize a display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

In order to attain the object a first display device of the present invention includes pixels provided so as to correspond to intersections of scanning signal lines and data signal lines, wherein: the pixels each includes: an electrooptic element having a driving potential input terminal to receive a potential for driving the electrooptic element; a first switching element between the driving potential input terminal of the electrooptic element and that one of the data signal lines which corresponds to the pixel; a first capacitor element whose first terminal is connected with the driving potential input terminal of the electrooptic element; a second capacitor element having a first terminal connected with the second terminal of the first capacitor element; and a second switching element disposed between (i) the one of the data signal lines and (ii) a node between the second terminal of the first capacitor element and the first terminal of the second capacitor element, the scanning signal lines includes: first scanning signal lines each connected with a conduction control terminal of the first switching element; and second scanning signal lines each connected with a conduction control terminal of the second switching element, the first scanning signal lines and the second scanning signal lines being paired in correspondence with the individual pixels, and the display device comprises potential lines connected with the second terminals of the second capacitor elements, respectively.

According to this invention, a period is first set up as a first period in which the first switching element and the second switching element are set in a conductive state and in a non-conductive state, respectively. This allows respective potentials of the driving potential input terminal of the electrooptic element and the first terminal of the first capacitor element to be set to the potential of the data signal line. The potentials of the data signal line and the second terminal of the first capacitor element during this period are referred to as Va and Vy, respectively.

Another period subsequent to the first period is set up as a second period in which the first switching element and the second switching element are set in the non-conductive state and in the conductive state, respectively. This allows the potential of the node of the first capacitor element and the second capacitor element, i.e., the potential of the second terminal of the first capacitor element to be set to the potential of the data signal line. When it is assumed that the potential of the data signal line during this period is Va, and the potential of the first terminal of the first capacitor element is changed into Vx, Vx is defined by the following equation:

$$Vx=Va+Cs(Va-Vy)/(Cs+Clc) \quad (7)$$

where Cs represents a capacitance value of the first capacitor element, and Clc represents a capacitance value obtained when the electrooptic element has a capacitance having the driving potential input terminal as one terminal.

If Va−Vy provides a positive value, Vx>Va. In a case where the polarity of the potential fed into the driving potential input terminal of the electrooptic element and the first terminal of the first capacitor element is inverted for every frame, Vy<0 can be satisfied. As a result, Va−Vy>0 can be satisfied.

Another period subsequent to the second period is set up as a third period in which the first switching element and the second switching element are both set in the non-conductive state. This allows storing the respective electric charges of the first capacitor element and the capacitance of the electrooptic element.

Because of this, the amplitude of a voltage applied to the driving potential input terminal of the electrooptic element can be larger than the amplitude of an output voltage from the data signal line driving circuit to the extent of Vx>Va described above. Therefore, it is possible to cause the effective value, during one frame period, of a voltage expressed by the difference between the potential of the driving potential input terminal and the reference potential to have a variance larger than the amplitude of an output voltage from the data signal line driving circuit, the variance corresponding to the variation in the signal voltage fed into the data signal line. Here, it is put that the potential of the driving potential input terminal is either not smaller or not greater than the reference potential at any given time during one frame period.

This ensures that, even when the voltage is changed within one frame period which voltage is expressed by the difference between the potential of the driving potential input terminal and the reference potential, the effective value of the voltage has a large variance which corresponds to the variation in the signal voltage fed into the data signal line. This eliminates the need to increase the amplitude of an output voltage from the data signal line driving circuit for the purpose of ensuring a desired effective value. As a result, it is possible to prevent an increase in the production costs and in power consumption.

A change in the potential of the potential line in the third period can cause a change in the potential of the driving potential input terminal through the second capacitor element and the first capacitor element, to the extent of the increase in the voltage amplitude, with anticipation that the amplitude of a voltage applied to the driving potential input terminal of the electrooptic element will be attenuated. This allows improving the response speed of the liquid crystal by causing the electrooptic element to carry out a high impulse display.

In a case where the electrooptic element is a liquid crystal element, the capability to increase the amplitude of an on/off voltage applied to the liquid crystal element by increasing the amplitude of a voltage applied to the driving potential input terminal of the liquid crystal element, i.e., the pixel electrode, allows for a wider selection of usable liquid crystals, and therefore allows a less viscous liquid crystal to be used. This further allows the response speed of the liquid crystal element to be improved even when the potential of the potential line is unchanged in the third period, and also allows a liquid crystal having a higher contrast to be used for an improved contrast.

In addition, when an identical liquid crystal is used so as to be driven with a voltage having a constant effective value, it is possible to further reduce the amplitude of an output voltage from the data signal line driving circuit. This also allows for reduced power consumption.

As a result, it is possible to realize a display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

In order to attain the object, the display device of the present invention may be arranged such that when display data is written to a target pixel among the pixels, the target pixel is driven through: a first period, during which the first switching element is in a conductive state and the second switching element is in a non-conductive state respectively; a second period, during which the first switching element is in in the non-conductive state, and the second switching element is in the conductive state respectively; and a third period, during which the first switching element and the second switching element are both in the non-conductive state.

According to the above invention, it is possible to realize a display device in which the factors for a high cost and an increase in power consumption are suppressed, and in which the effective value of a voltage expressed by the difference between (i) a potential applied to an electrooptic element and (ii) a reference potential can have a variance larger than the amplitude of a signal voltage fed into a data signal line, the variance corresponding to the variation in the signal voltage.

The display device of the present invention may be arranged such that the potential line is changed in potential in the third period.

According to the above invention, a change in the potential of the potential line in the third period can cause a change in the potential of the driving potential input terminal through the second capacitor element and the first capacitor element to the extent of the increase in the amplitude of the voltage applied to the driving potential input terminal of the electrooptic element, with anticipation that the amplitude of a voltage applied to the driving potential input terminal of the electrooptic element will be attenuated. This allows improving the response speed of the liquid crystal by causing the electrooptic element to carry out a high impulse display.

In order to attain the object, a second display device of the present invention includes pixels provided so as to correspond to intersections of scanning signal lines and the data signal lines, wherein: the pixels each includes: an electrooptic element having a driving potential input terminal to receive a potential for driving the electrooptic element; a first switching element between the driving potential input terminal of the electrooptic element and that one of the data signal lines which corresponds to the pixel, the first switching element having a conduction control terminal connected with one of the scanning signal lines, the outputs of the data signal line driving circuit being capable of being selectively set in a high impedance state, depending on the data signal lines.

According to the above invention, a period is first set up as a first period in which the first switching element is set in a conductive state, and each of the data signal lines is fed with a potential corresponding to display data for the pixels from the data signal line driving circuit. This allows the potential of the driving potential input terminal of the electrooptic element to be set to the potential corresponding to the display data. The potential corresponding to the display data during this period is designated by Va. Put that Vg is either (i) a potential of a counter electrode of the electrooptic element which counter electrode would form a capacitance with the driving potential input terminal of the electrooptic element if the counter electrode was provided to the electrooptic element, or (ii) a potential of scanning signal lines (hereinafter referred to as the other scanning signal lines) other than the scanning signal lines connected with the pixels to which the display data is to be written. Then, either (i) the voltage between the driving potential input terminal and the counter electrode, or (ii) the voltage between the driving potential input terminal and the other scanning signal lines, is Va−Vg.

Another period subsequent to the first period is set up as a second period in which the first switching element is set in the conductive state. In addition, outputs of the data signal line driving circuit which outputs are connected with selected ones of the data signal lines are set in a high impedance state, whereas the data signal line driving circuit feeds each of the remaining data signal lines with a potential corresponding to the display data. This allows an electric charge to be maintained in each of the data signal lines corresponding to the outputs in the high impedance state, and also allows each of the remaining data signal lines to maintain the potential Va corresponding to the display data.

Subsequently, further during the same second period, a change is caused to the potential of each of the driving potential input terminals connected with the data signal lines corresponding to the outputs in the high impedance state. This is achieved by either changing the potential of each of the counter electrodes into Vk, or changing the potential of the other scanning signal lines into Vk. At this stage, the voltage between (i) the driving potential input terminal and (ii) the counter electrode or the other scanning signal lines can be maintained at about Va−Vk. Meanwhile, the voltage between (i) each of the driving potential input terminals connected with the remaining data signal lines and (ii) the counter electrode or the other scanning signal lines is changed into Va−Vk. The potential of each of the scanning signal lines connected with the pixels to which the display data is to be written may also be changed by the amount of Vk−Vg as in the other scanning signal lines.

Another period subsequent to the second period is set up as a third period in which the first switching element is set in a non-conductive state. This allows storing an electric charge in the driving potential input terminal.

When the amplitude of an output voltage from the data signal line driving circuit is expressed as Vd(off)−Vd(on), since a change in the potential of the counter electrode or the other scanning signal lines is expressed as Vk−Vg, the amplitude of a voltage of the driving potential input terminal is Vd(off)−Vd(on)+Vk−Vg.

Thus, when the change Vk−Vg in the voltage is set so that the following inequality is satisfied, the amplitude of a voltage applied to the driving potential input terminal is caused to be larger than that of an output voltage from the data signal line driving circuit.

$$|Vd(\text{off})-Vd(\text{on})+Vk-Vg|>|Vd(\text{off})-Vd(\text{on})| \quad (8)$$

Therefore, it is possible to cause the effective value of a voltage expressed by the difference between the potential of the driving potential input terminal and the reference potential to have a variance larger than the amplitude of an output voltage from the data signal line driving circuit, the variance corresponding to the variation in the signal voltage fed into the data signal line.

This ensures that, even when the voltage is changed within one frame period which voltage is expressed by the difference between the potential of the driving potential input terminal and the reference potential, the effective value of the voltage has a large variance which corresponds to the variation in the signal voltage fed into the data signal line. This eliminates the need to increase, for the purpose of ensuring a desired effective value, the amplitude of an output voltage from the data signal line driving circuit. As a result, it is possible to prevent an increase in the production costs and in power consumption.

In a case where the electrooptic element is a liquid crystal element, the capability to increase the amplitude of an on/off voltage applied to the liquid crystal element by increasing the amplitude of a voltage applied to the driving potential input terminal of the liquid crystal element, i.e., the pixel electrode, allows for a wider selection of usable liquid crystals, and therefore allows a less viscous liquid crystal to be used. This further allows the response speed of the liquid crystal element to be improved even when the potential of the potential line is unchanged in the third period, and also allows a liquid crystal having a higher contrast to be used for an improved contrast.

In addition, when an identical liquid crystal is used so as to be driven with a voltage having a constant effective value, it is possible to reduce the amplitude of an output voltage from the data signal line driving circuit. This also allows for reduced power consumption.

As a result, it is possible to realize a display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

The display device of the present invention may further include potential lines, the pixels each further including a first capacitor element having: a first terminal connected with the driving potential input terminal of the electrooptic element; and a second terminal connected with one of the potential lines.

According to the above invention, a change in the potential of the potential line in the third period can cause a change in the potential of the driving potential input terminal through the first capacitor element to the extent of the increase in the amplitude of the voltage applied to the driving potential input terminal of the electrooptic element, with anticipation that the amplitude of a voltage applied to the driving potential input terminal of the electrooptic element will be attenuated. This allows improving the response speed of the liquid crystal by causing the electrooptic element to carry out a high impulse display.

The display device of the present invention may be arranged such that, when display data is written to a target pixel among the pixels, the target pixel is driven through: a first period, during which the first switching element is set in a conductive state, and the data signal line driving circuit feeds, to the data signal line, a potential corresponding to the display data for the target pixel; a second period, during which the first switching element is set in the conductive state, the data signal lines include selected data signal lines and remaining data signal lines, the data signal line driving circuit feeds the selected data signal lines with outputs in a high impedance state respectively, the data signal line driving circuit feeds the remaining data signal lines with respective potentials corresponding to the display data, and, in a case where a capacitance is formed between a counter electrode and the driving potential input terminal of the electrooptic element, a potential of the counter electrode is changed, or a potential of the scanning signal lines other than the scanning signal line connected to the target pixel is changed; and a third period, during which the first switching element is set in a non-conductive state.

According to the above invention, it is possible to easily realize a display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

In order to attain the object, the display device of the present invention may be arranged such that, when display data is written to a target pixel among the pixels, the target pixel is driven through: a first period, during which the first switching element is set in a conductive state, and the data signal line driving circuit feeds, to the data signal line, a potential corresponding to the display data for the target pixel; a second period, during which the first switching element is set in the conductive state, the data signal lines include selected data signal lines and remaining data signal lines, the data signal line driving circuit feeds the selected data signal lines with outputs in a high impedance state respectively, the data signal line driving circuit feeds the remaining data signal lines with potentials corresponding to the display data; and a third period, during which the first switching element is set in a non-conductive state, and the potential line is changed in potential.

According to the above invention, a change in the potential of the potential line in the third period can cause a change in the potential of the driving potential input terminal through the first capacitor element to the extent of the increase in the amplitude of the voltage applied to the driving potential input terminal of the electrooptic element, with anticipation that the amplitude of a voltage applied to the driving potential input terminal of the electrooptic element will be attenuated. This allows improving the response speed of the liquid crystal by causing the electrooptic element to carry out a high impulse display.

The display device of the present invention may be arranged such that the pixels each further include a pixel electrode, wherein the electrooptic element is a liquid crystal element, and the driving potential input terminal is a terminal of the liquid crystal element, the terminal being connected with the pixel electrode.

According to the above invention, it is possible to realize a liquid crystal display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

The display device of the present invention may be arranged such that the electrooptic element is an element including: an organic electroluminescence element; and a driver thin film transistor for driving the organic electroluminescence element, and the driving potential input terminal is a gate terminal of the driver thin film transistor.

According to the above invention, it is possible to realize an organic EL display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the difference in the signal voltage.

The display device of the present invention may be arranged such that the first switching element and the second switching element are thin film transistors, and the respective conduction control terminals of the first switching element and the second switching element are respective gate terminals of the thin film transistors.

According to the above invention, a display device can be constructed through a TFT process.

In order to attain the object, the display device of the present invention may be arranged such that the first switching element is a thin film transistor, and the conduction control terminal is a gate terminal of the thin film transistor.

According to the above invention, a display device can be constructed through a TFT process.

Additional objects, features, and strengths of the present invention will be made clear by the description below. Further, the advantages of the present invention will be evident from the following explanation in reference to the drawings.

BRIEF DESCRIPTION OF DRAWINGS

FIG. 3 is a table showing a result of the operation of FIG. 2 with a first numerical example.

FIG. 4 is a table showing a result of the operation of FIG. 2 with a second numerical example.

EXPLANATIONS OF REFERENCE NUMERALS

1, 16, 36: display device
18: source driver circuit (data signal line driving circuit)
51: element including an organic EL element (electrooptic element)
Aij, Aij (1), Aij (1'), Aij (2), Aij (2'): pixel
Gi: gate line (scanning signal line)
Gai: gate line (first scanning signal line)
Gbi: gate line (second scanning signal line)
Sj: source line (data signal line)
Ui: auxiliary capacitance line (potential line)
Q1: TFT (first switching element)
Q2: TFT (second switching element)
Cs: auxiliary capacitor (first capacitor element)
Cp: auxiliary capacitor (second capacitor element)
LC: liquid crystal element (electrooptic element)
com: counter electrode

BEST MODE FOR CARRYING OUT THE INVENTION

Embodiment 1

One embodiment of the present invention is described below with reference to FIGS. 1 through 7.

Figure 6:
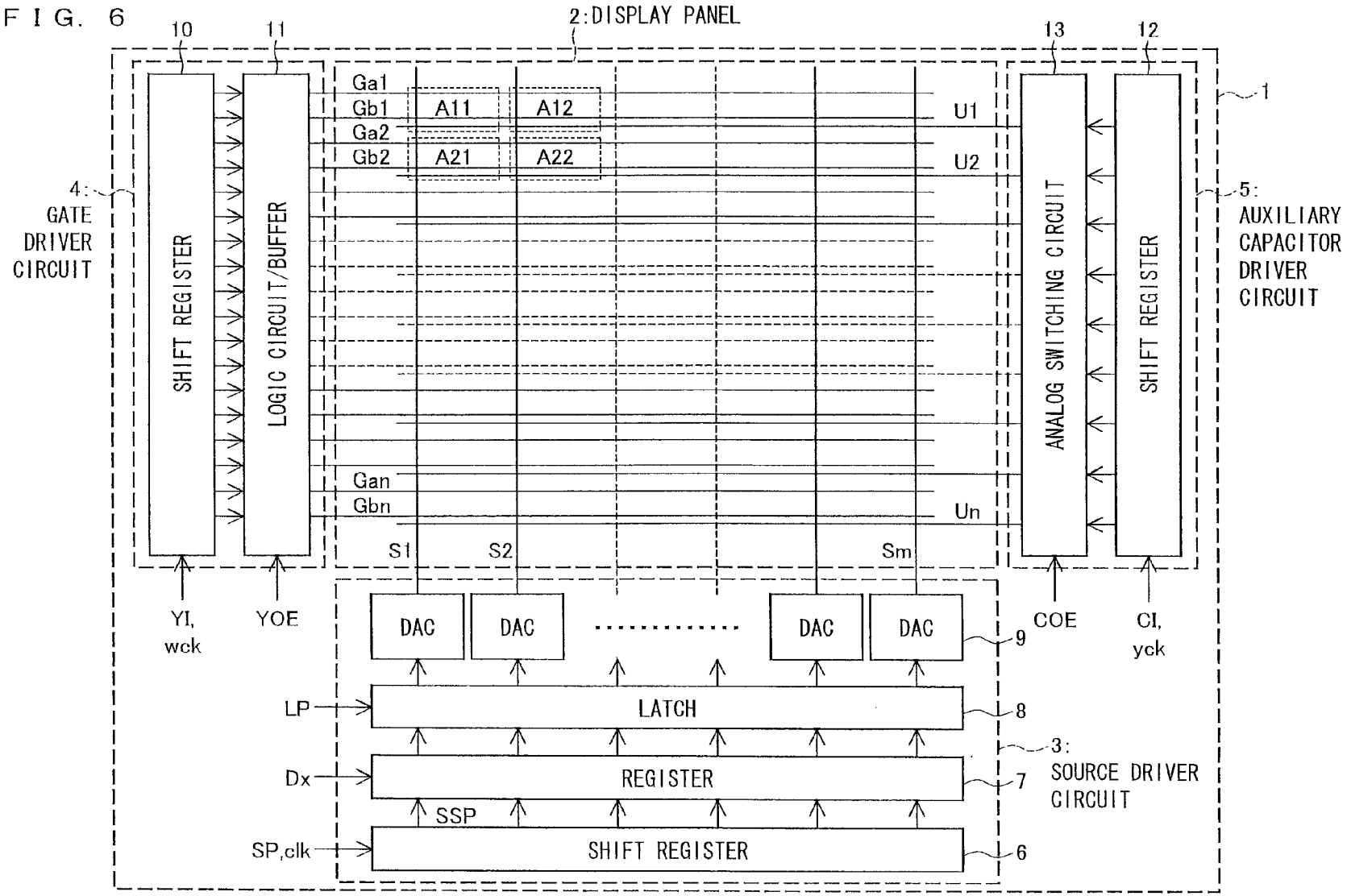
FIG. 6 is a block diagram showing an arrangement of the first display device in accordance with the embodiment of the present invention.

FIG. 6 shows an arrangement of a display device 1 serving as a first display device of the present embodiment. The display device 1 includes: a display panel 2; a source driver circuit 3; a gate driver circuit 4; and an auxiliary capacitor driver circuit 5.

The display panel 2 includes: n gate lines (first scanning signal lines) Gai; n gate lines (second scanning signal lines) Gbi (where i=1 to n); m source lines (data signal lines) Sj (where j=1 to m); and pixels Aij disposed respectively in association with the intersections of the gate lines Gai and Gbi with the source lines Sj. The gate lines Gai and the gate lines Gbi are drawn from the gate driver circuit (scanning signal line driving circuit; described below) 4 so as to extend parallel to each other on the display panel 2. The gate lines (scanning signal lines) of the present embodiment are provided so that a pair of one of the gate lines Gai and one of the gate lines Gbi corresponds to one of the pixels Aij. The source lines Sj are drawn from the source driver circuit (data signal line driving circuit; described below) 3 so as to extend on the display panel 2. The display panel 2 further includes auxiliary capacitance lines (potential lines) Ui. The auxiliary capacitance lines Ui are drawn from the auxiliary capacitor driver circuit 5 (described below) so as to extend parallel to the gate lines. Gai and Gbi on the display panel 2.

The gate lines Gai and Gbi and the auxiliary capacitance lines Ui are disposed so as to cross the source lines Sj orthogonally.

The gate driver circuit 3 includes: an m-bit shift register 6; an m×6-bit register 7; an m×6-bit latch 8; and m 6-bit D/A converter circuits 9.

First, a start pulse SP is fed into the first stage of the shift register 6. The start pulse SP is sent through the shift register 6 in accordance with a clock pulse clk, and is then fed to the register 7 as a timing pulse SSP. The register 7, in accordance with the timing pulse SSP sent from the shift register 6, holds externally fed 6-bit data Dx at a position which coincides with a corresponding one of the source lines Sj. In accordance with the timing of a latch pulse LP, the latch 8 acquires m×6 bits of data held in the register 7. Then, the latch 8 feeds the data into the D/A converter circuits 9. Each of the D/A converter circuits 9 feeds into a corresponding one of the source lines Sj a potential which corresponds to the 6-bit data fed from the latch 8.

The gate driver circuit 4 includes: a shift register 10; and a logic circuit/buffer 11. The shift register 10 is fed with a start pulse Y1 and a clock pulse wck. The start pulse Y1 fed into the shift register 10 is sent through the shift register 10 in accordance with the clock pulse wck. The logic circuit/buffer 11 obtains a logical product (AND) of (i) each of output signals from the individual stages of the shift register 10 and (ii) an externally fed control signal YOE. The logic circuit/buffer 11 then feeds a selection potential or a non-selection potential into each of the gate lines Gai and Gbi in accordance with the result of the logical operation.

In this way, the source driver circuit 3 and the gate driver circuit 4 write display data to the pixels Aij for each of the gate lines Gai and Gbi, by sequentially selecting the gate lines Gai and Gbi.

The auxiliary capacitor driver circuit 5 includes: a shift register 12; and an analog switching circuit 13. The shift register 12 is fed with a selection signal CI and a clock pulse yck. The selection signal CI fed into the shift register 12 is sent through the shift register 12 in accordance with the clock pulse yck. The analog switching circuit 13 performs a logical operation on a combination of each of output signals from the individual stages of the shift register 12 and an externally fed control signal COE. By the analog switching circuit 13, a potential corresponding to the result of the logical operation is then fed into each of the auxiliary capacitance lines Ui.

Figure 1:
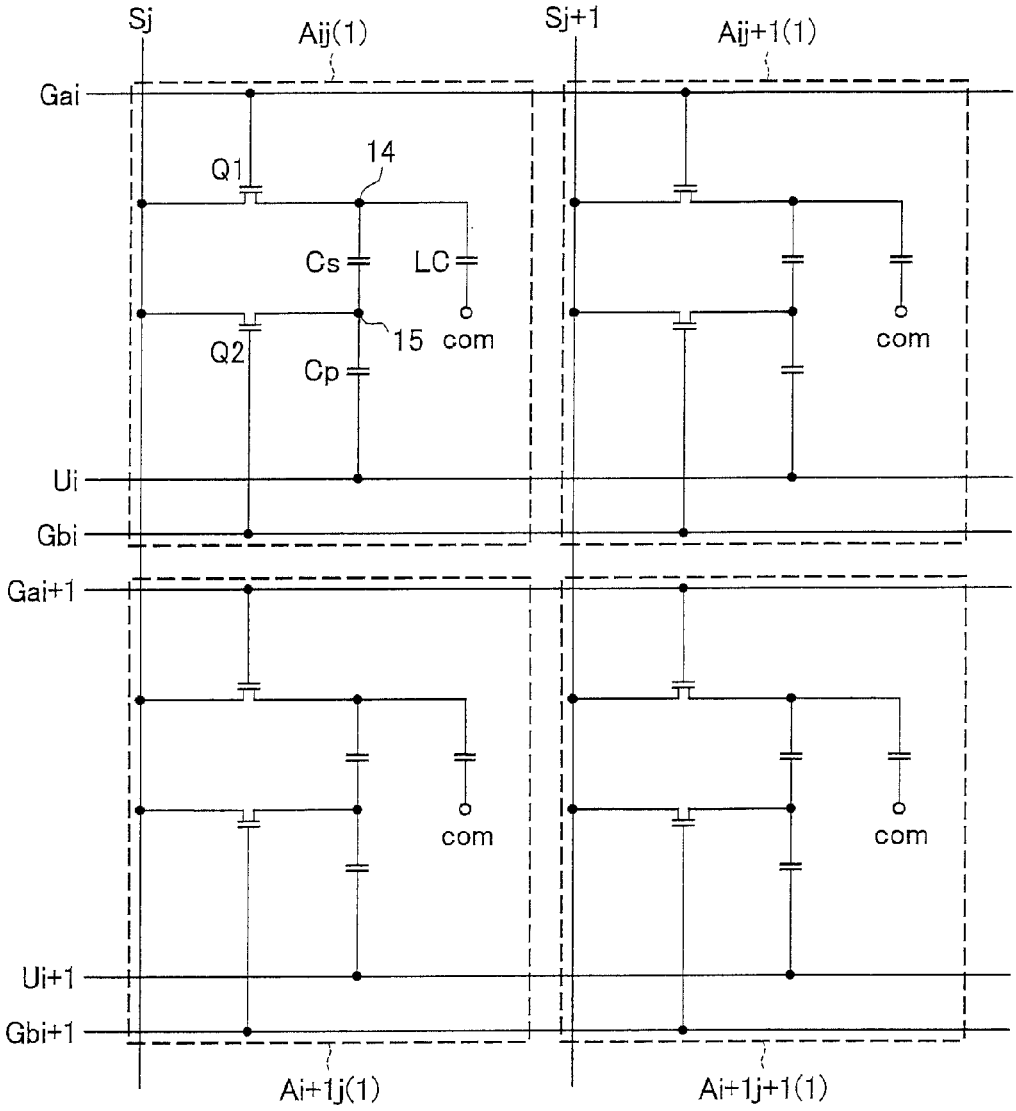
FIG. 1 is a circuit diagram showing an arrangement of pixels included in a first display device in accordance with an embodiment of the present invention.

FIG. 1 shows an arrangement of a pixel Aij (1) serving as one of the pixels Aij. The pixel Aij (1) includes: a TFT (first switching element):Q1; a liquid crystal element (electrooptic element) LC; an auxiliary capacitor (first capacitor element) Cs; a TFT (second switching element):Q2; and an auxiliary capacitor (second capacitor element) Cp. FIG. 1 shows four pixels; namely, Aij (1), Ai+1j (1), Aij+1 (1), and Ai+1j+1 (1).

The TFT:Q1 includes: a gate terminal (conduction control terminal) connected with the gate line Gai; a source terminal connected with the source line Sj; and a drain terminal connected with a pixel electrode 14. The pixel electrode 14 is further connected with one terminal of the liquid crystal element LC and one terminal of the auxiliary capacitor Cs. The other terminal of the liquid crystal element LC is connected with a counter electrode com. The other terminal of the auxiliary capacitor Cs is connected with one terminal of the auxiliary capacitor Cp. The other terminal of the auxiliary capacitor Cp is connected with the auxiliary capacitance line Ui. The node of the auxiliary capacitors Cs and Cp is herein designated referred to as the node 15. In addition, the TFT:Q2 includes: a gate terminal (conduction control terminal) connected with the gate line Gbi; a source terminal connected with the source line Sj; and a drain terminal connected with the node 15.

The pixel electrode 14 and the terminal of the liquid crystal element LC which terminal is connected with one terminal of the auxiliary capacitor Cs serve as a driving potential input terminal. A potential for driving the liquid crystal element LC is fed into this terminal.

Figure 2:
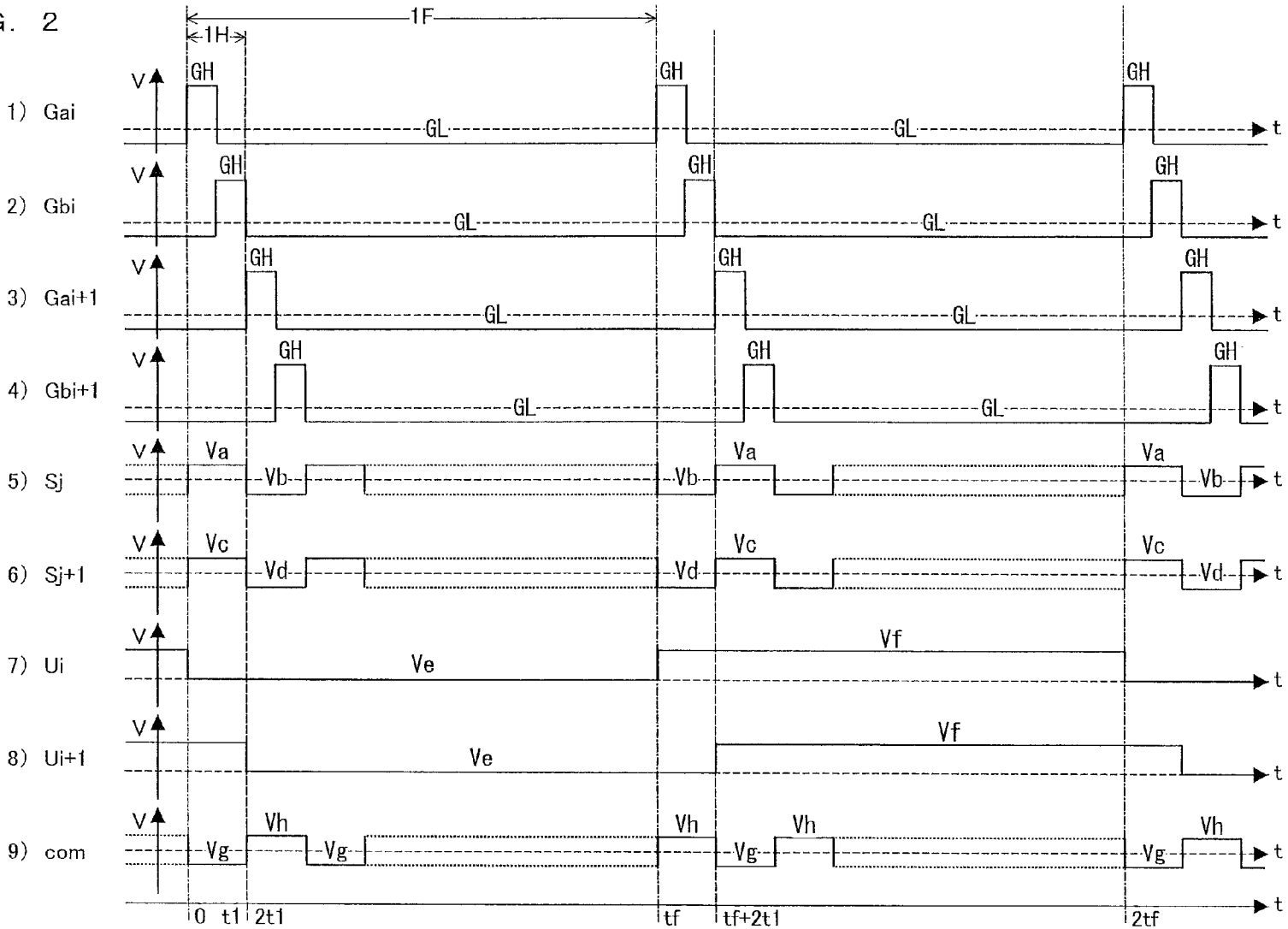
FIG. 2 is a timing chart showing a first operation performed by the first display device when display data is written to the pixels of FIG. 1.

With reference to a timing chart of FIG. 2, the following description deals with how the display device 1 operates when display data is written to the Aij (1).

FIG. 2 shows respective potentials of (i) the gate lines Gai, Gbi, Gai+1, and Gbi+1, (ii) the source lines Sj and Sj+1, (iii) the auxiliary capacitance lines Ui and Ui+1, and (iv) the counter electrode corm. The counter electrode corn is fed with a potential from a switching circuit (not shown). In FIG. 2, one frame period and one horizontal period are referred to as 1F and 1H, respectively.

In FIG. 2, the period from time 0 to time t1 is a first period of a first frame. During this period, the gate line Gai is fed with a potential GH (selection potential), while the gate line Gbi is fed with a potential GL (non-selection potential). This sets the TFT:Q1 and the TFT:Q2 in an ON state and in an OFF state, respectively. During the same period, the source line Sj is fed with a potential Va corresponding to video data Dxij, from the D/A converter circuit 9 shown in FIG. 6. This sets the potential of the pixel electrode 14 to Va. The potential of the node 15 is unclear at this stage and is referred to as Vy.

Assume that, immediately before the first period, potentials Vr and Vz are stored in the pixel electrode 14 and the node 15, respectively, while potentials of the auxiliary capacitance line Ui and the counter electrode corn are Ve and Vg respectively.

Since the potential of the node 15 is stored during the first period, the following equation is satisfied:

$$Cs(Vz-Vr)+Cp(Vz-Ve)=Cs(Vy-Va)+Cp(Vy-Ve) \quad (9)$$

wherein Vy is the potential of the node 15 during the first period, Cs is to a capacitance value of the auxiliary capacitor Cs, and Cp is a capacitance value of the auxiliary capacitor Cp. According to the equation (9), the following equations are satisfied:

$$(Cs+Cp)Vy=(Cs+Cp)Vz+Cs(Va-Vr) \therefore Vy=Vz+Cs(Va-Vr)/(Cs+Cp) \quad (10)$$

The period from time t1 to time 2*t*1 is a second period of the first frame. During this period, the gate line Gai is fed with a potential GL (non-selection potential) so that the TFT:Q1 is set in the OFF state. Further, the gate line Gbi is fed with a potential GH (selection potential) so that the TFT:Q2 is set in the ON state.

The potential Va corresponding to the video data Dxij is continuously fed into the source line Sj from the D/A converter circuit 9 during this period as well.

This sets the potential of the node 15 to Va. The potential of the pixel electrode 14 is changed into Vx in this period.

The relationship between the potential Vx and the potentials Va and Vy is defined as follows.

The electric charge accumulated in the pixel electrode 14 is stored during the first and second periods of the first frame. Therefore, the following equations are satisfied:

$$Cs(Va-Vy)+Clc(Va-Vg)=Cs(Vx-Va)+Clc(Vx-Vg) \quad (11)$$

wherein Clc represents a capacitance value of the liquid crystal element LC. In the present embodiment, the potential of the counter electrode com is maintained at Vg during the second period. According to the equation (11), the following equations are satisfied:

$$(Cs+Clc)Vx=(Cs+Clc)Va+Cs(Va-Vy) \therefore Vx=Va+Cs(Va-Vy)/(Cs+Clc) \quad (12)$$

According to the equation (12), if Va−Vy provides a positive value, Vx>Va. Since the polarity of the potential fed into the pixel electrode 14 is inverted for every frame, Vz<0 can be satisfied, and therefore Vy<0 can be satisfied according to the equation (10). As a result, Va−Vy>0 can be satisfied.

The period from time 2*t*1 to time tf is a third period of the first frame. During this period, each of the gate lines Gai and Gbi is fed with a potential GL (non-selection potential). This sets both of the TFT:Q1 and the TFT:Q2 in the OFF state.

This allows storing the respective electric charges of the pixel electrode 14 and the node 15.

The period from time tf to time tf+t1 is a first period of a second frame for the pixel Aij (1). During this period, the gate line Gai is fed with a potential GH (selection potential), while the gate line Gbi is fed with a potential GL (non-selection potential). This sets the TFT:Q1 and the TFT:Q2 in the ON state and in the OFF state, respectively. During the same period, the source line Sj is fed with a potential Vb corresponding to video data Dxij, from the D/A converter circuit 9.

This sets the potential of the pixel electrode 14 to Vb. The potential of the node 15 is changed into Vs in this period. Since the electric charge of the node 15 is stored (during a second period of the second frame and thereafter), the following equation is satisfied:

$$Cs(Va-Vx)+Cp(Va-Ve)=Cs(Vs-Vb)+Cp(Vs-Vf) \quad (13)$$

wherein Vf represents a potential of the auxiliary capacitance line Ui during the second frame.

According to the equation (13), the potential Vs of the node 15 is defined by the following equations:

$$(Cs+Cp)Vs=(Cs+Cp)Va+Cs(Vb-Vx)+Cp(Vf-Ve) \therefore Vs=Va+(Cs(Vb-Vx)+Cp(Vf-Ve))/(Cs+Cp) \quad (14)$$

The period from time tf+t1 to time tf+2*t*1 is a second period of the second frame for the pixel Aij (1). During this period, the gate line Gai is fed with a potential GL (non-selection potential) so that the TFT:Q1 is set in the OFF state. Further, the gate line Gbi is fed with a potential GH (selection potential) so that the TFT:Q2 is set in the ON state. The potential Vb corresponding to the video data Dxij is continuously fed into the source line Sj from the D/A converter circuit 9 during this period as well.

This sets the potential of the node 15 to Vb. The potential of the pixel electrode 14 is changed into Vt in this period.

The relationship between the potential Vt and the potentials Vb and Vs is defined as follows.

The electric charge accumulated in the pixel electrode 14 is stored during the first and second periods of the second frame. Therefore, the following equations are satisfied:

$$Cs(Vb-Vs)+Clc(Vb-Vh)=Cs(Vt-Vb)+Clc(Vt-Vh) \quad (15)$$

wherein Vh represents a potential of the counter electrode corn during the first and second periods of this frame.

According to the equation (15), the following equations are satisfied:

$$(CS+Clc)Vt=(Cs+Clc)Vb+Cs(Vb-Vs) \therefore Vt=Vb+Cs(Vb-Vs)/(Cs+Clc) \quad (16)$$

The description below deals with how the respective potentials of the pixel electrode 14 and the node 15 are changed by repetition of the above period shift under the following conditions: initial potentials Vr and Vz of the pixel electrode 14 and the node 15 both being 0V; potentials Ve and Vf of the auxiliary capacitance line Ui being 0V and 2V, respectively; and potentials −Vg and Vh of the counter electrode corn both being 1V.

When an output voltage from the source driver circuit 3 is Va=−Vb=2V (since a frame inversion driving is performed, Va equals −Vb in carrying out a display of a static image), the respective potentials of the pixel electrode 14 and the node 15 are changed as shown in FIG. 3.

As is clear from FIG. 3, the potential Vx of the pixel electrode 14 converges to 3.2V (Vt converges to −3.2V) during each second period, regardless of initial values of the potentials Vr and Vz.

When an output voltage from the source driver circuit 3 is Va=−Vb=0V (since a frame inversion driving is performed, Va equals −Vb in carrying out a display of a static image), the respective potentials of the pixel electrode 14 and the node 15 are changed as shown in FIG. 4.

As is clear from FIG. 4, the potential Vx of the pixel electrode 14 converges to 0.4V (Vt converges to −0.4V) during each second period, regardless of initial values of the potentials Vr and Vz.

The potentials Vx=3.2V and Vx=0.4 of the pixel electrode 14 are herein designated by Von and Voff, respectively. As is clear from FIGS. 3 and 4, in the present embodiment, while the amplitude of the output voltage from the source driver circuit 3 is 2V, the difference between the on-voltage Von and the off-voltage Voff applied to the liquid crystal element LC is 2.8V.

As explained above using the equation (12), this indicates the ability to cause the amplitude of an on/off voltage applied to the liquid crystal element LC to be larger than the amplitude of an output voltage from the source driver circuit 3, to the extent of Vx>Va. Therefore, the display device of the present embodiment is capable of causing a variance in the effective value of a voltage applied to the liquid crystal element LC during one frame period to be larger than the amplitude of an output voltage from the source driver circuit 3. The voltage applied to the liquid crystal element LC is expressed by the difference between (i) the potential of the pixel electrode 14 serving as the driving potential input terminal and (ii) the potential of the counter electrode com serving, i.e., a reference potential. The above variance corresponds to the variation in the signal voltage fed into the source line Sj. The potential of the pixel electrode 14 is either not smaller or not greater than the potential of the counter electrode com at any given time during one frame period.

This ensures that, even when a voltage applied to the liquid crystal element LC is changed within one frame period, a variance in the effective value of such a voltage is large, the variance corresponding to the variation in the signal voltage fed into the source line Sj. This eliminates the need to increase the amplitude of the output voltage from the source driver circuit 3, thereby ensuring a desired effective value of a voltage applied to the liquid crystal element LC. Consequently, it is possible to prevent an increase in the production costs and in power consumption.

The above allows realizing a display device in which the factors for a high cost and an increase in power consumption are suppressed, and in which the effective value of a voltage applied to the liquid crystal element LC can have a variance larger than the amplitude of a signal voltage fed into the source line Sj, the variance corresponding to the variation in the signal voltage.

The capability to increase the amplitude of the on/off voltage applied to the liquid crystal element LC allows for a wider selection of usable liquid crystals. This allows a less viscous liquid crystal to be used and thereby improves the response speed of the liquid crystal element LC. It further allows the use of a liquid crystal having a higher contrast, thereby attaining better contrast. In addition, in a case where an identical liquid crystal is used so as to be driven with a voltage having a constant effective value, it is possible to reduce the amplitude of an output voltage from the source driver circuit 3. This further allows for lower power consumption.

Figure 5:
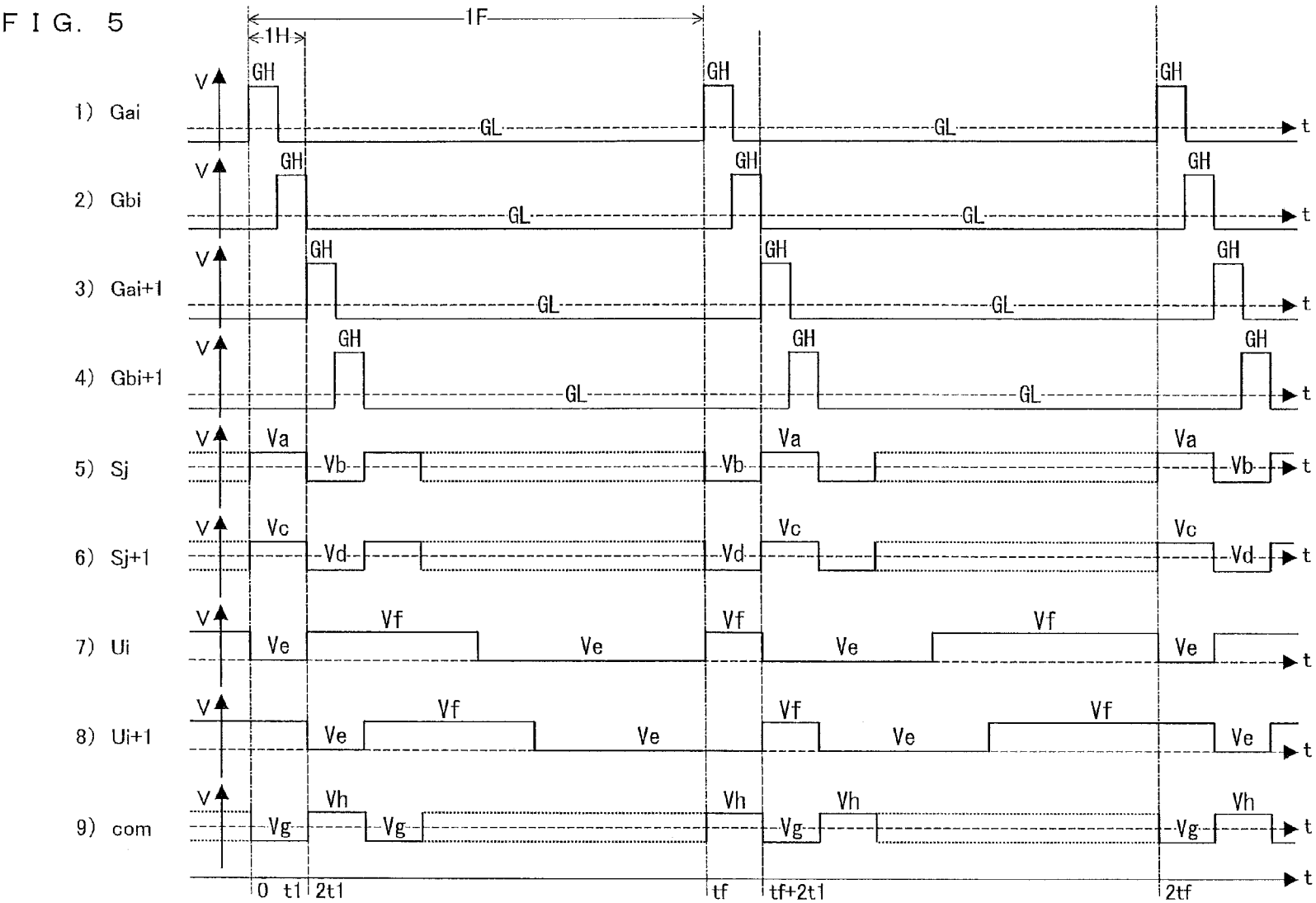
FIG. 5 is a timing chart showing a second operation performed by the first display device when display data is written to the pixels of FIG. 1.

Since it is possible to increase the amplitude of the on/off voltage applied to the liquid crystal element LC as described above, the potential of the auxiliary capacitance line Ui can be changed within one frame period as shown in FIG. 5 to the extent of the increase in the voltage amplitude, with anticipation that the amplitude of the on/off voltage will be attenuated. As shown in FIG. 5, the potential of the auxiliary capacitance line Ui during the first half of the third period is set to the potential Vf which is different from the potential Ve in the second half of the third period. A change in the potential of the auxiliary capacitance line Ui causes a change in the potential of the pixel electrode 14 through the auxiliary capacitors Cp and Cs.

As a result, the response speed of the liquid crystal can be improved by causing the liquid crystal element LC to carry out a high impulse display. Another reason the response speed of the liquid crystal can be improved according to the operation shown in FIG. 5 is that a higher voltage is applied to the liquid crystal element LC during the first half of one frame period by setting the potential of the auxiliary capacitance line Ui to Vf.

In the present embodiment, a liquid crystal element LC is used as an electrooptic element. However, the electrooptic element is not limited to this, and may be an element including an organic EL element, for example.

Figure 7:
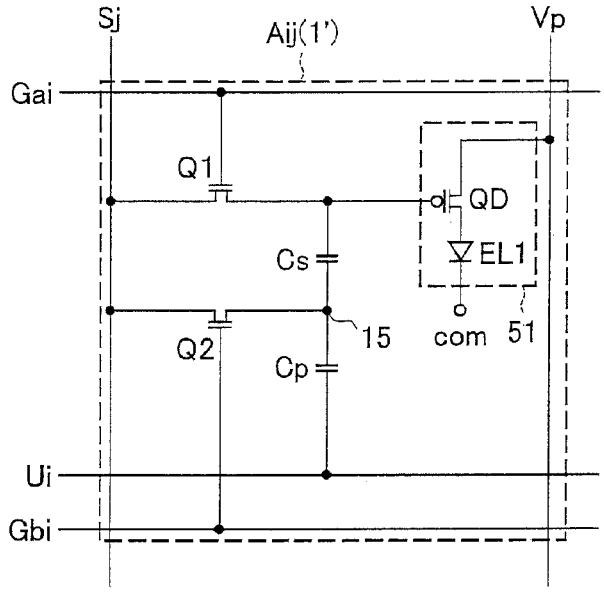
FIG. 7 is a circuit diagram showing an arrangement of a modification of the pixels of FIG. 1.

FIG. 7 shows an arrangement of a pixel Aij (1') including, as an electrooptic element, an element 51 which includes an organic EL element. Elements in the pixel Aij (1') which perform the same functions as in the pixel Aij (1) of FIG. 1 are assigned the same reference numerals, and that the description of such elements is omitted.

The pixel Aij (1') includes: a TFT (first switching element): Q1; an organic EL element EL1; a driver TFT:QD; an auxiliary capacitor (first capacitor element) Cs; a TFT (second switching element):Q2; and an auxiliary capacitor (second capacitor element) Cp. The organic EL element EL1 and the driver TFT:QD constitute the element 51 including an organic EL element. A display panel 2 includes: gate lines Gai and Gbi; source lines Sj; potential lines Ui; and power supply lines Vp. The power supply lines Vp are drawn from a voltage supply (not shown) so as to be disposed in a one-to-one correspondence with the individual columns of the pixels Aij (1').

The driver TFT:QD is a p-type TFT, including: a gate terminal connected with one terminal of the auxiliary capacitor Cs and the TFT:Q1; a source terminal connected with one of the power supply lines Vp; and a drain terminal connected with the anode of the organic EL element EL1. The cathode of the organic EL element EL1 is connected with a common electrode com. In this arrangement, a potential applied to the gate terminal of the driver TFT:QD determines a current to flow into the organic EL element EL1. The organic EL element EL1 then emits light having a luminance which corresponds to the current. In other words, the organic EL element EL1 is driven. Therefore, the gate terminal of the driver TFT:QD serves as a driving potential input terminal for the element 51 including an organic EL element.

Further, the reference potential in this arrangement is a potential Vp of the power supply line Vp. A voltage expressed by the difference between (i) the potential of the gate terminal of the driver TFT:QD, which terminal serves as a driving potential input terminal, and (ii) the potential Vp serving as a reference potential is a gate-source voltage of the driver TFT:QD. Thus, the effective value of the gate-source voltage during one frame period corresponds to the amount of a current flowing into the organic EL element EL1, i.e., to the luminance of the organic EL element EL1.

The operation of the pixel Aij (1') can be explained with the equation (11) and its subsequent equations by setting Ccl to 0. It is assumed that the potential of the common electrode does not vary in this arrangement because the variation in the potential of the common electrode shown in FIGS. 2 and 5 concerns the liquid crystal element LC.

Embodiment 2

Another embodiment of the present invention is described below with reference to FIGS. 8 through 13.

Figure 8:
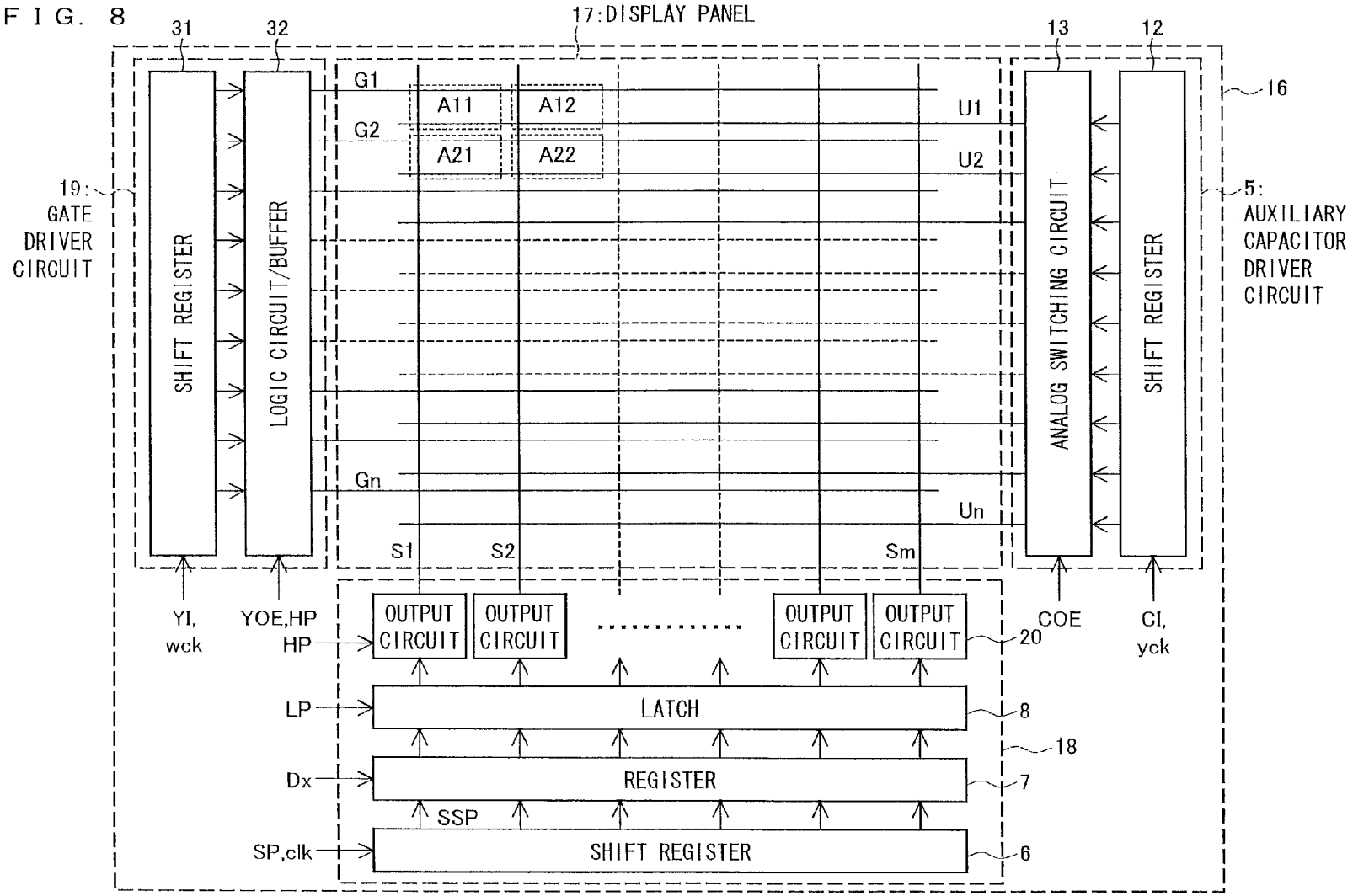
FIG. 8 is a block diagram showing an arrangement of a second display device in accordance with another embodiment of the present invention.

FIG. 8 shows an arrangement of a display device 16 serving as a second display device of the present embodiment.

The display device 16 includes: a display panel 17; a source driver circuit 18; a gate driver circuit 19; and an auxiliary capacitor driver circuit 5.

The display panel 17 includes: n gate lines (scanning signal lines) Gi (where i=1 to n); m source lines (data signal lines) Sj (where j=1 to m); and pixels Aij disposed so as to correspond to the intersections of the gate lines Gi with the source lines Sj. The gate lines Gi are drawn from the gate driver circuit (scanning signal line driving circuit; described below) 19 so as to extend on the display panel 17. The source lines Sj are drawn from the source driver circuit (data signal line driving circuit; described below) 18 so as to extend on the display panel 17. The display panel 2 further includes auxiliary capacitance lines (potential lines) Ui. The auxiliary capacitance lines Ui are drawn from the auxiliary capacitor driver circuit 5 (described below) so as to extend on the display panel 17 parallel to the gate lines Gi.

The gate lines Gi and the auxiliary capacitance lines Ui are disposed so as to cross the source lines Sj orthogonally.

The source driver circuit 18 includes: an m-bit shift register 6; an m×6-bit register 7; an m×6-bit latch 8; and m 6-bit output circuits 20.

A start pulse SP is fed into the first stage of the shift register 6. The start pulse SP is sent through the shift register 6 in accordance with a clock pulse clk, and is then fed into the register 7 as a timing pulse SSP. The register 7, in accordance with the timing pulse SSP sent from the shift register 6, holds externally fed 6-bit data Dx at a position which coincides with a corresponding one of the source lines Sj. The latch 8, in accordance with the timing of a latch pulse LP, acquires m×6 bits of data held in the register 7, and feeds the data into the output circuits 20. Each of the output circuits 20 feeds into a corresponding one of the source lines Sj a potential which corresponds to the 6-bit data fed from the latch 8.

The gate driver circuit 19 includes: a shift register 31; and a logic circuit/buffer 32. The shift register 31 is fed with a start pulse Y1 and a clock pulse wck. The start pulse Y1 fed into the shift register 31 is sent through the shift register 31 in accordance with the clock pulse wck. The logic circuit/buffer 32 obtains a logical product (AND) of (i) each of output signals from the individual stages of the shift register 31 and (ii) an externally fed control signal YOE. The logic circuit/buffer 32 then feeds a selection potential or a non-selection potential into each of the gate lines Gi in accordance with the result of the logical operation. The logic circuit/buffer 32 is fed with a control signal HP. When the control signal HP is low, an output connected with a gate line Gi into which a non-selection potential is to be fed is set in a high impedance state. Thus, the gate line Gi and the output of the logic circuit/buffer 32 are in an open-circuit state with respect to each other. Meanwhile, an output of the logic circuit/buffer 32 connected with a gate line Gi into which a selection potential is to be fed may be in a high impedance state or otherwise. This can be achieved, for example, by providing an analog switch at each output of the logic circuit/buffer 32 so that a gate signal can be selected for each of the outputs. When a selection potential is a high signal, and that a non-selection potential is a low signal, it is possible to cause only a gate line Gi in a non-selection state to be in a high impedance state by obtaining a logical product of the gate signal and a signal which is high only during the latter half of a selection period, and then providing the result to the gate terminal of a corresponding one of the analog switches.

As described above, the source driver circuit 18 and the gate driver circuit 19 write display data to the pixels Aij for the gate lines Gi in line-sequential manner by sequentially selecting the gate lines Gi.

The auxiliary capacitor driver circuit 5 includes: a shift register 12; and an analog switching circuit 13. The shift register 12 is fed with a selection signal CI and a clock pulse yck. The selection signal CI fed into the shift register 12 is sent through the shift register 12 in accordance with the clock pulse yck. The analog switching circuit 13 performs a logical operation on a combination of each of output signals from the individual stages of the shift register 12 and an externally fed control signal COE. The analog switching circuit 13 then feeds into each of the auxiliary capacitance lines Ui a potential corresponding to the result of the logical operation.

Figure 9:
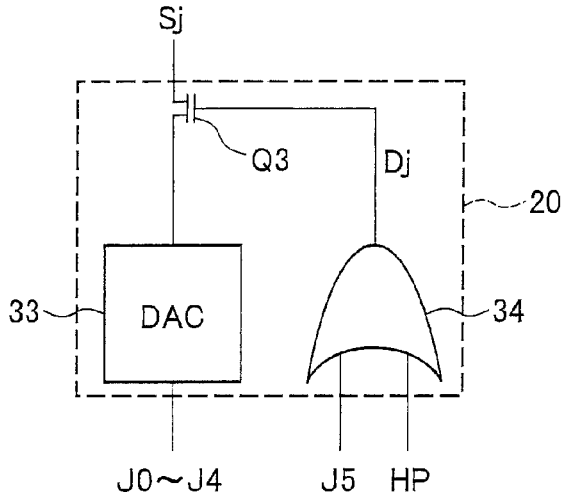
FIG. 9 is a circuit block diagram showing an arrangement of an output circuit included in a source driver circuit of the second display device of FIG. 8.

As shown in FIG. 9, each of the output circuits 20 includes: a 5-bit D/A converter circuit 33; an OR circuit 34; and a transistor Q3. The transistor Q3 is an n-type MOS transistor, and serves as a switching element for switching over connection and disconnection of an output of the D/A converter circuit 33 with a source line Sj. The output terminal of the OR circuit 34 is connected with the gate terminal of the transistor Q3.

The D/A converter circuit 33 is fed with five less significant bits (J0 through J4) out of the 6-bit data Dxij from the latch 8. The D/A converter circuit 33 converts the five less significant bits into an analog voltage to be outputted to the source line Sj. The most significant bit (J5) in the data Dxij is fed into one of the two inputs of the OR circuit 34, while a control signal HP is fed into the other input. The OR circuit 34 performs a logical operation for obtaining the sum of the most significant bit and the control signal HP so as to control switching between a conductive state and a blocking state of the transistor Q3. The transistor Q is set in the blocking state only when both inputs fed into the OR circuit 34 are low. Otherwise, the transistor Q3 is set in the conductive state. When the transistor Q is in the blocking state, the source line Sj and the output circuit 20 are set in an open-circuit state with respect to each other.

This allows the individual outputs of the output circuits 20 of the source driver circuit 18 to be selectively set in a high impedance state with respect to the corresponding source lines Sj.

Figure 10:
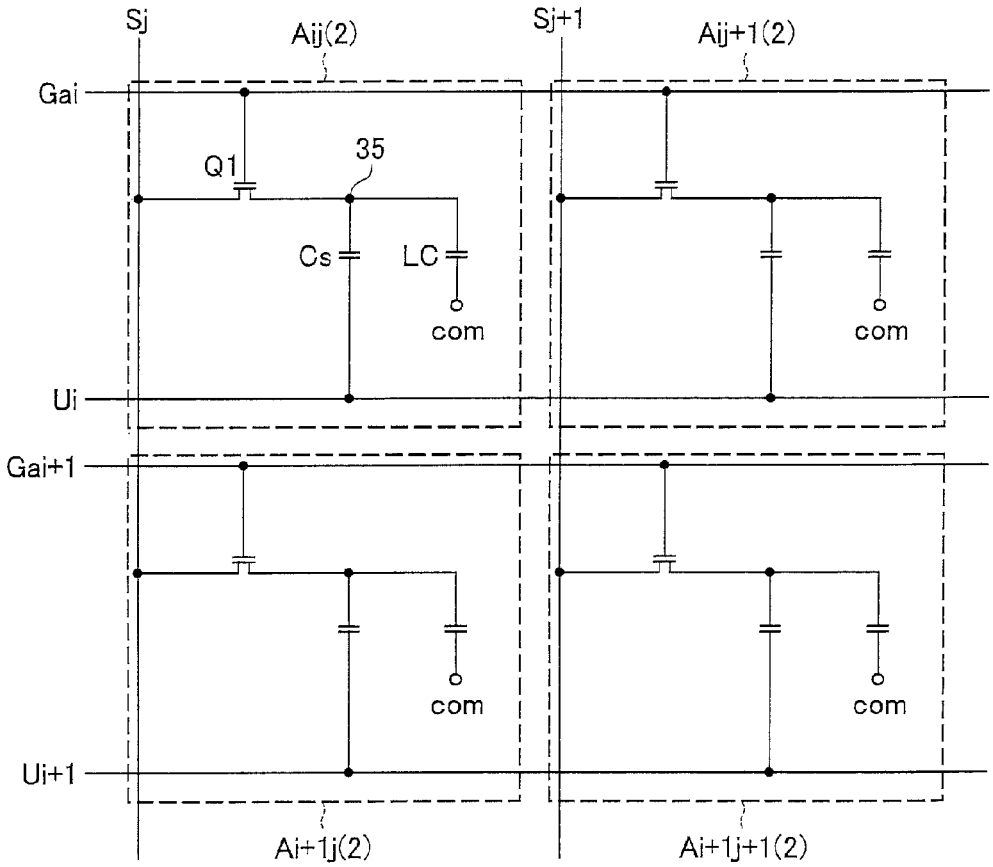
FIG. 10 is a circuit diagram showing an arrangement of pixels included in the second display device of FIG. 8.

FIG. 10 shows an arrangement of a pixel Aij (2) serving as one of the pixels Aij. The pixel Aij (2) includes: a TFT (first switching element):Q1; a liquid crystal element (electrooptic element) LC; and an auxiliary capacitor (first capacitor element) Cs. FIG. 10 shows four pixels; namely, Aij (2), Ai+1j (2), Aij+1 (2), and Ai+1j+1 (2).

The TFT:Q1 includes: a gate terminal (conduction control terminal) connected with the gate line Gi; a source terminal connected with the source line Sj; and a drain terminal connected with a pixel electrode 35. The pixel electrode 35 is further connected with one terminal of the liquid crystal element LC and one terminal of the auxiliary capacitor Cs. The other terminal of the liquid crystal element LC is connected with a counter electrode com. The other terminal of the auxiliary capacitor Cs is connected with the auxiliary capacitance line Ui.

The pixel electrode 35 and the terminal of the liquid crystal element LC which terminal is connected with one terminal of the auxiliary capacitor Cs serve as a driving potential input terminal. A potential for driving the liquid crystal element LC is fed into this terminal.

Figure 11:
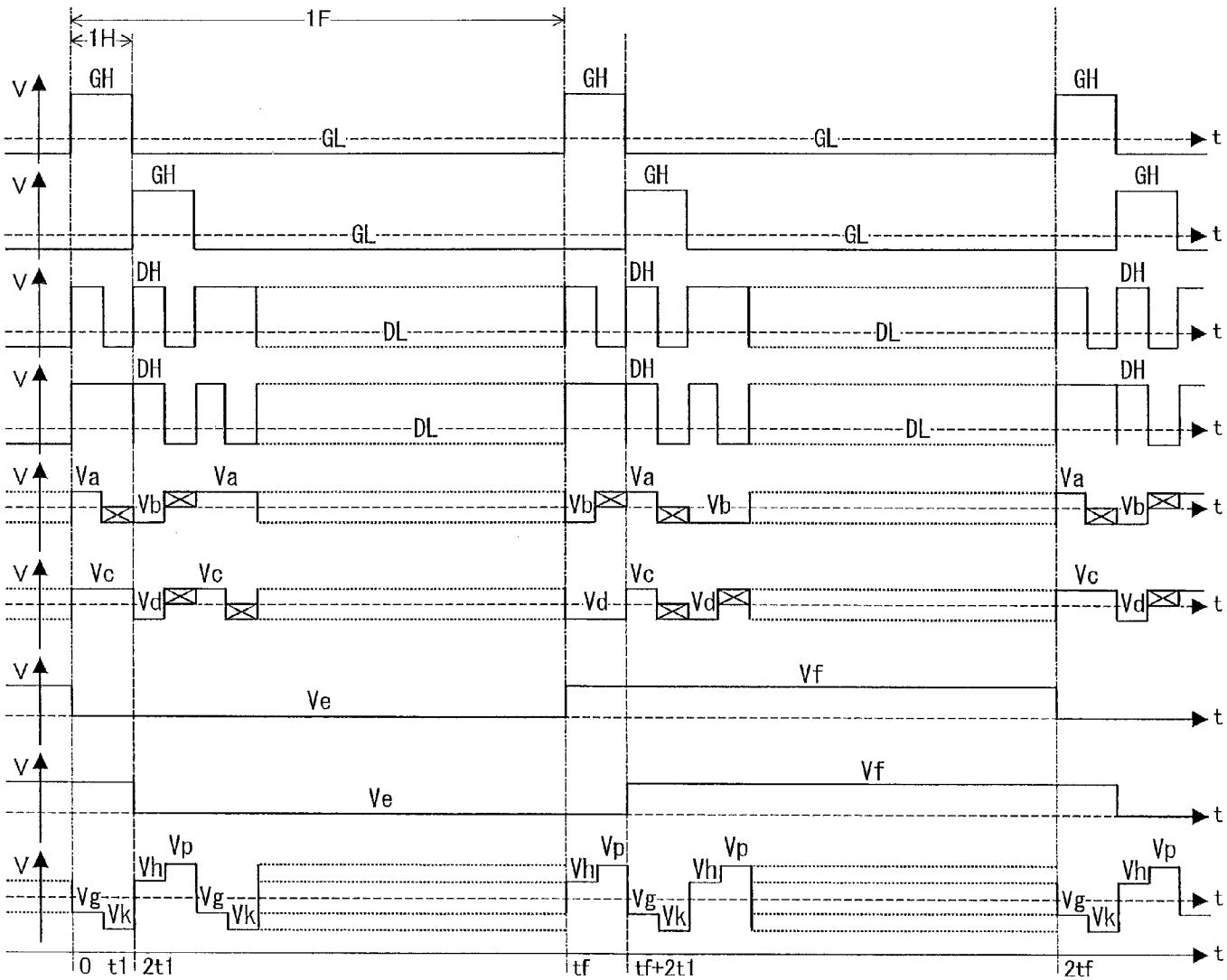
FIG. 11 is a timing chart showing a first operation performed by the second display device when display data is written to the pixels of FIG. 10.

With reference to a timing chart of FIG. 11, the following description deals with how the display device 16 operates when display data is written to the Aij (2).

FIG. 11 shows respective potentials of (i) the gate lines Gi and Gi+1, (ii) outputs Dj and Dj+1 of the OR circuits 34, (iii) the source lines Sj and Sj+1, (iv) the auxiliary capacitance lines Ui and Ui+1, and (v) the counter electrode corm. The counter electrode corn is fed with a potential from a switching circuit (not shown). In FIG. 11, one frame period and one horizontal period are designated by 1F and 1H, respectively.

In FIG. 11, the period from time 0 to time t1 is a first period of a first frame. During this period, the gate line Gi is fed with a potential GH (selection potential), while the other gate line Gk (where k≠i) is fed with a potential GL (non-selection potential). This sets a TFT:Q1 which corresponds to a pixel connected with the gate line Gi in an ON state, and also sets a TFT:Q1 which corresponds to a pixel connected with the gate line Gk in an OFF state.

During this period, video data Dxij is fed, for example as a potential Va, from a corresponding one of the D/A converter circuits 33 into the source line Sj. In addition, video data Dxij+1 is fed, for example as a potential Vc, into the source line Sj+1.

The potential of the counter electrode corn is set to Vg during this period.

The period from time t1 to time 2*t*1 is a second period of the first frame. During this period, the control signal HP is set on low. It is possible to continue applying a potential GH to the gate line Gi during this period. It is also possible to cause the gate line Gi and the corresponding output of the logic circuit/buffer 32 to be set in an open-circuit state with respect to each other. Meanwhile, the gate line Gk and the logic circuit/buffer 32 are set in an open-circuit state with respect to each other so that an electric charge of the gate line Gk is stored. The relative potential between the gate line Gk and the pixel electrode 35 is maintained in this case as well. With this, the TFT:Q1 that corresponds to a pixel connected with the gate line Gk can be maintained in the OFF state.

During the second period, when the most significant bit (J5) in the video data Dxij is in a high state, an output Dj of the OR circuit 34 is set in a high state (DH). This sets the transistor Q3 in the conductive state and thereby allows the video data Dxij to be fed from the D/A converter circuit 33 into the source line Sj.

In contrast, when the most significant bit (J5) in the video data Dxij is in a low state, an output Dj of the OR circuit 34 is set in a low state (DL). This sets the transistor Q3 in the blocking state and thereby sets the source line Sj and the corresponding output circuit 20 in an open-circuit state with respect to each other.

In this state, the potential Vg of the counter electrode com is changed into Vk. This allows a potential difference Va−Vg between the pixel electrode 35 and the counter electrode com to be stored in the source line Sj which is in an open-circuit state with respect to each other. Since the display device 16 performs an alternating-current driving of the display panel 17, the potential of the counter electrode corn is set to Vh during a first period and is changed into Vp in a second period when the polarity is reversed.

The potential Vc is maintained in the source line Sj+1 connected with a corresponding one of the D/A converter circuits 33. Therefore, a potential difference between the pixel electrode 35 and the counter electrode corn is defined by Vc−Vk.

When it is assumed that the amplitude of an output voltage from the source driver circuit 18 is Vd(off)−Vd(on), the amplitude of a voltage in the pixel electrode 35 is determined by Vd(off)−Vd(on)+Vk−Vg since a change in the potential of the counter electrode corn is determined by Vk−Vg.

Thus, when the change Vk−Vg in the voltage is set so that the following inequality is satisfied, the amplitude of a voltage applied to the pixel electrode 35 is caused to be larger than that of an output voltage from the source driver circuit 18.

$$Vd(\text{off})-Vd(\text{on})+Vk-Vg|>|Vd(\text{off})-Vd(\text{on})| \quad (17)$$

When Va=0V, Vc=2V, Vg=−1V, and Vk=−2V, the amplitude of a voltage applied to the pixel electrode 35 is as follows:

$$Va-Vg=1\text{V}$$

$$Vc-Vk=4\text{V}$$

This voltage amplitude results from the addition of the change Vg−Vk in the potential of the counter electrode corn to the 2V amplitude of a voltage from the corresponding D/A converter circuit 33.

In the above method for driving the pixel Aij (2), the potential of the auxiliary capacitance line Ui is switched between Ve and Vf for every frame in accordance with the alternating-current driving, while the potential is kept at a constant level within one frame period.

The increase in the amplitude of a voltage applied to the pixel electrode 35 indicates that the amplitude of an on/off voltage applied to the liquid crystal element LC can be larger than the amplitude of an output voltage from the source driver circuit 18. Therefore, the display device of the present embodiment is can be such that a variance in the effective value of a voltage applied to the liquid crystal element LC during one frame period can be larger than the amplitude of an output voltage from the source driver circuit 18. The voltage applied to the liquid crystal element LC is expressed by the difference between (i) the potential of the pixel electrode 35 serving as the driving potential input terminal and (ii) the potential of the counter electrode com serving, i.e., a reference potential. The above variance corresponds to the variation in the signal voltage fed into the source line Sj.

This ensures that, even when a voltage applied to the liquid crystal element LC is changed within one frame period, a variance in the effective value of such a voltage is large, the variance corresponding to the variation in the signal voltage fed into the source line Sj. This eliminates the need to increase the amplitude of the output voltage from the source driver circuit 18 for the purpose of ensuring a desired effective value of a voltage applied to the liquid crystal element LC. Consequently, it is possible to prevent an increase in the production costs and in power consumption.

The above realizes a display device in which the factors for a high cost and an increase in power consumption are suppressed, and in which the effective value of a voltage applied to the liquid crystal element LC can have a variance larger than the amplitude of a signal voltage fed into the source line Sj, the variance corresponding to the variation in the signal voltage.

The capability to increase the amplitude of the on/off voltage applied to the liquid crystal element LC allows for a wider selection of usable liquid crystals. This allows a less viscous liquid crystal to be used and thereby improves the response speed of the liquid crystal element LC. It further allows the use of a liquid crystal having a higher contrast for an improved contrast. In addition, in a case where an identical liquid crystal is used so as to be driven with a voltage having a constant effective value, it is possible to reduce the amplitude of an output voltage from the source driver circuit 18. This further allows for reduced power consumption.

Figure 12:
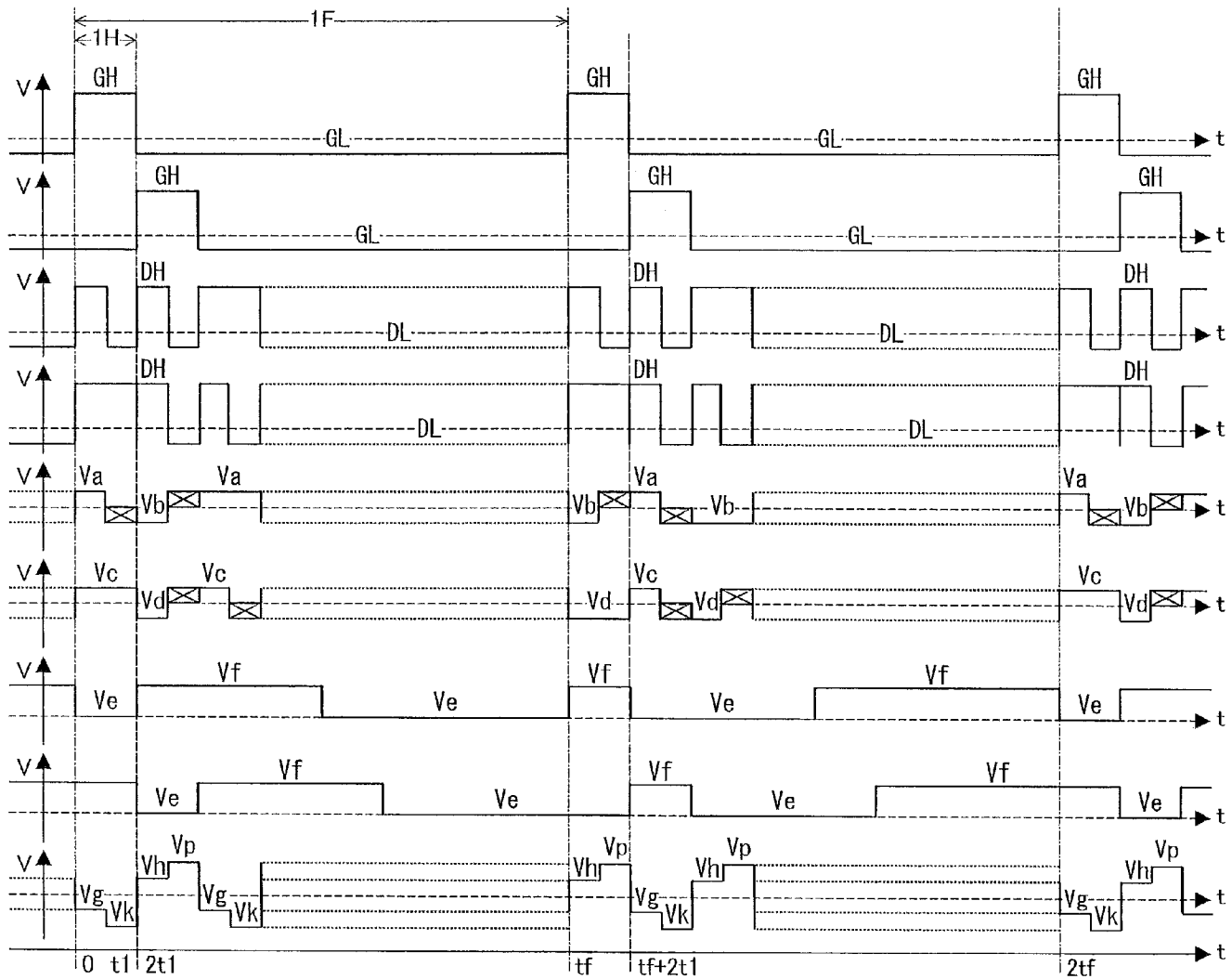
FIG. 12 is a timing chart showing a second operation performed by the second display device when display data is written to the pixels of FIG. 10.

Since it is possible to increase the amplitude of the on/off voltage applied to the liquid crystal element LC as described above, the potential of the auxiliary capacitance line Ui can be changed within one frame period as shown in FIG. 12 to the extent of the increase in the voltage amplitude, with anticipation that the amplitude of the on/off voltage will be attenuated. As shown in FIG. 12, the potential of the auxiliary capacitance line Ui during the first half of the third period is set to the potential Vf which is different from the potential Ve in the second half of the third period. A change in the potential of the auxiliary capacitance line Ui causes a change in the potential of the pixel electrode 35 through the auxiliary capacitor Cs.

As a result, the response speed of the liquid crystal can be improved by causing the liquid crystal element LC to carry out a high impulse display. Another reason the response speed of the liquid crystal can be improved according to the operation shown in FIG. 12 is that a higher voltage is applied to the liquid crystal element LC during the first half of one frame period by setting the potential of the auxiliary capacitance line Ui to Vf.

In actuality, there is a stray capacitance in each of the intersections of the source lines Sj and the gate lines Gk on the display panel 17. In view of this, it is preferable to cause the potential GL of each of the gate lines Gk in a non-selection state to change into GL−Vg+Vk in the second period, instead of causing each output of the logic circuit/buffer 32 which is connected with a corresponding one of the gate lines Gk in a non-selection state to be set in a high impedance state. The stray capacitance charged between the source line Sj and each of the gate lines Gk in the non-selection state is larger than the capacitance between the pixel electrode 35 and the counter electrode com. Thus, the potential of the source line Sj can be changed by the amount of Vg−Vk even when the potential of the counter electrode com is maintained at Vg and the potential GL of the gate line Gk in the non-selection state is changed into GL−Vg+Vk+Va (wherein Va represents an extra voltage added in view of the effect of a capacitive coupling between the source line Sj and the counter electrode corn so that the potential of the source line Sj in a high impedance state is changed by the amount of −Vg+Vk). Meanwhile, the potential of the gate line Gi in a selection state may be changed or unchanged in the second period. This is because a change in the potential of a single gate line Gi in the selection state causes no large influence on the potential of the source line Sj, since even a QVGA display has a large number of gate lines, e.g., 240 (landscape display) or 320 (portrait display). When the second period has elapsed, the TFT:Q1 is set in the OFF state in the same manner as in the above embodiment.

In the present embodiment, a liquid crystal element LC is used as an electrooptic element. However, the electrooptic element is not limited to this, and may be an element including an organic EL element, for example.

Figure 13:
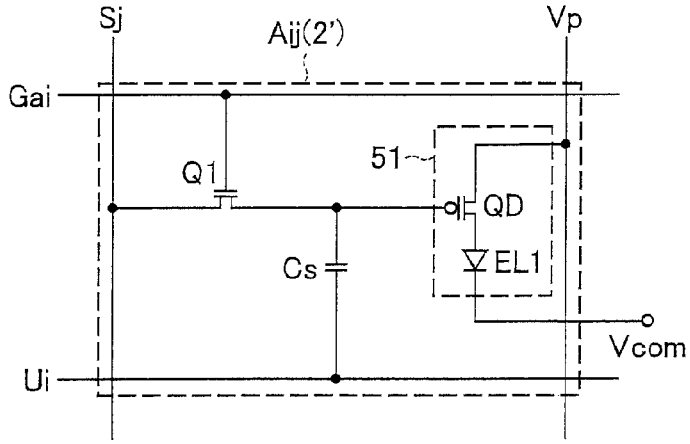
FIG. 13 is a circuit diagram showing an arrangement of a modification of the pixels of FIG. 10.

FIG. 13 shows an arrangement of a pixel Aij (2') including, as an electrooptic element, an element 51 which includes an organic EL element. Elements in the pixel Aij (2') which perform the same functions as in the pixel Aij (2) of FIG. 10 are assigned the same reference numerals, and that the description of such elements is omitted.

The pixel Aij (2') includes: a TFT (first switching element): Q1; an organic EL element EL1; a driver TFT:QD; and an auxiliary capacitor (first capacitor element) Cs. The organic EL element EL1 and the driver TFT:QD constitute the element 51 including an organic EL element. A display panel 17 includes: gate lines Gi; source lines Sj; potential lines Ui; and power supply lines Vp. The power supply lines Vp are drawn from a voltage supply (not shown) so as to be disposed in a one-to-one correspondence with the individual columns of the pixels Aij (2').

The driver TFT:QD is a p-type TFT, including: a gate terminal connected with one terminal of the auxiliary capacitor Cs and the TFT:Q1; a source terminal connected with one of the power supply lines Vp; and a drain terminal connected with the anode of the organic EL element EL1. The cathode of the organic EL element EL1 is connected with a common electrode com. In this arrangement, a potential applied to the gate terminal of the driver TFT:QD determines a current to flow into the organic EL element EL1. The organic EL element EL1 then emits light having a luminance which corresponds to the current. In other words, the organic EL element EL1 is driven. Therefore, the gate terminal of the driver TFT:QD serves as a driving potential input terminal for the element 51 including an organic EL element.

Further, the reference potential in this arrangement is a potential Vp of the power supply line Vp. A voltage expressed by the difference between (i) the potential of the gate terminal of the driver TFT:QD, which terminal serves as a driving potential input terminal, and (ii) the potential Vp serving as a reference potential is a gate-source voltage of the driver TFT:QD. Thus, the effective value of the gate-source voltage during one frame period corresponds to the amount of a current flowing into the organic EL element EL1, i.e., to the luminance of the organic EL element EL1.

In the pixel Aij (2'), a stray capacitance between the source line Sj and the gate line Gk is used in place of a change in the potential of the counter electrode com shown in FIGS. 11 and 12. The potential GL of each of the gate lines Gk in the non-selection state is changed into GL−Vg+Vk instead of causing the outputs of the logic circuit/buffer 32 that are connected with the individual gate lines Gk in the non-selection state to be set in a high impedance state. This allows changing the potential of the source line Sj by the amount of Vg−Vk.

Embodiment 3

Another embodiment of the present invention is described below with reference to FIGS. 9, 10, and 14 through 16.

Figure 14:
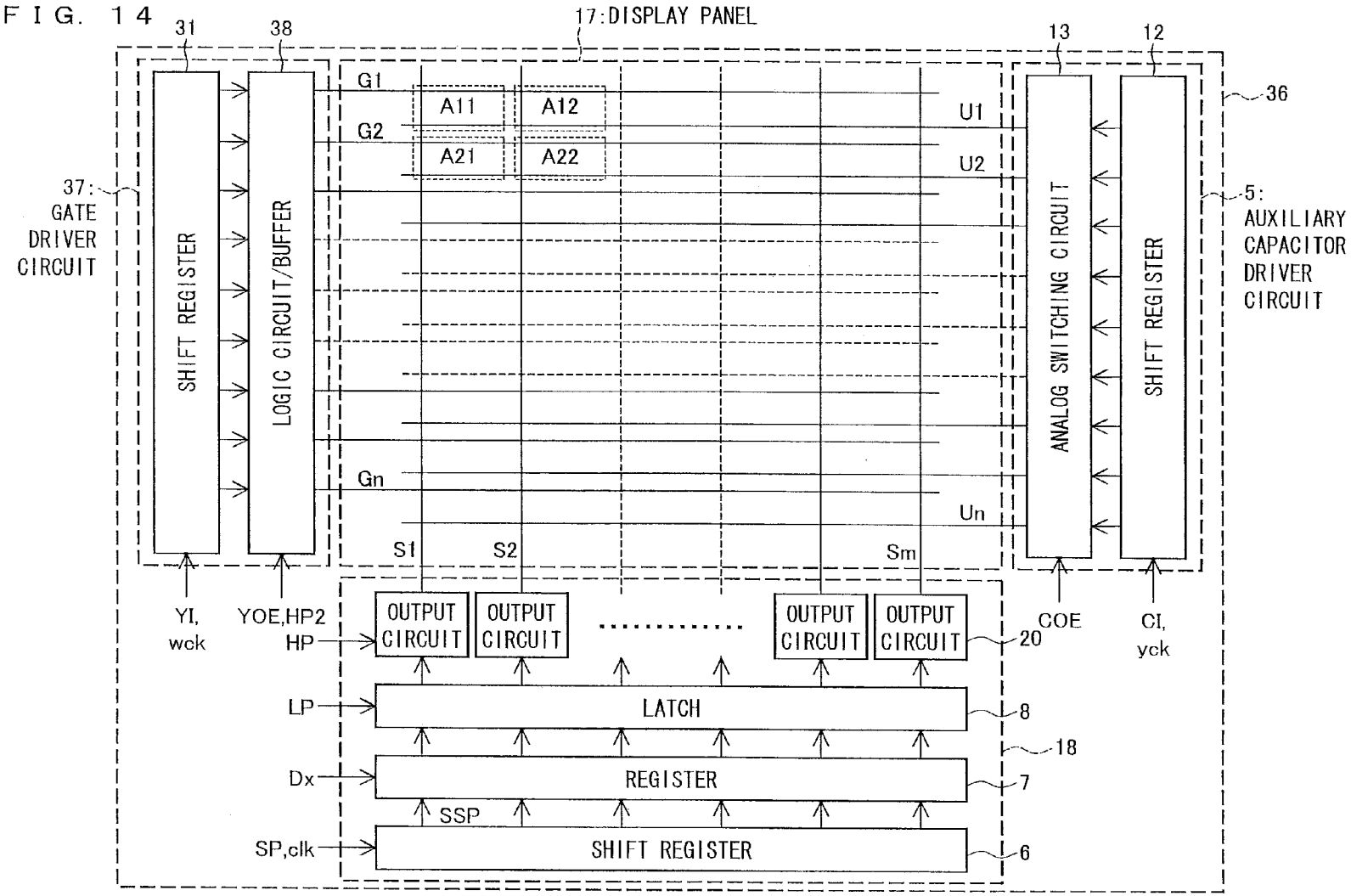
FIG. 14 is a block diagram showing an arrangement of a third display device in accordance with another embodiment of the present invention.

FIG. 14 shows an arrangement of a display device 36 of the present embodiment.

The display device 36 includes: a display panel 17; a source driver circuit 18; a gate driver circuit 37; and an auxiliary capacitor driver circuit 5.

In other words, the present embodiment is different from Embodiment 2 simply at a point that the gate driver is made up of the gate driver circuit (scanning signal line driving circuit) 37. The gate driver circuit 37 includes: a shift register 31; and a logic circuit/buffer 38. The shift register 31 is the same as in Embodiment 2. The logic circuit/buffer 38 is capable of outputting selection potentials GH1 and GH2 and non-selection potentials GL1 and GL2.

The pixel Aij of the present embodiment has the same arrangement as that of the pixel Aij (2) in FIG. 10 described in Embodiment 2.

Figure 15:
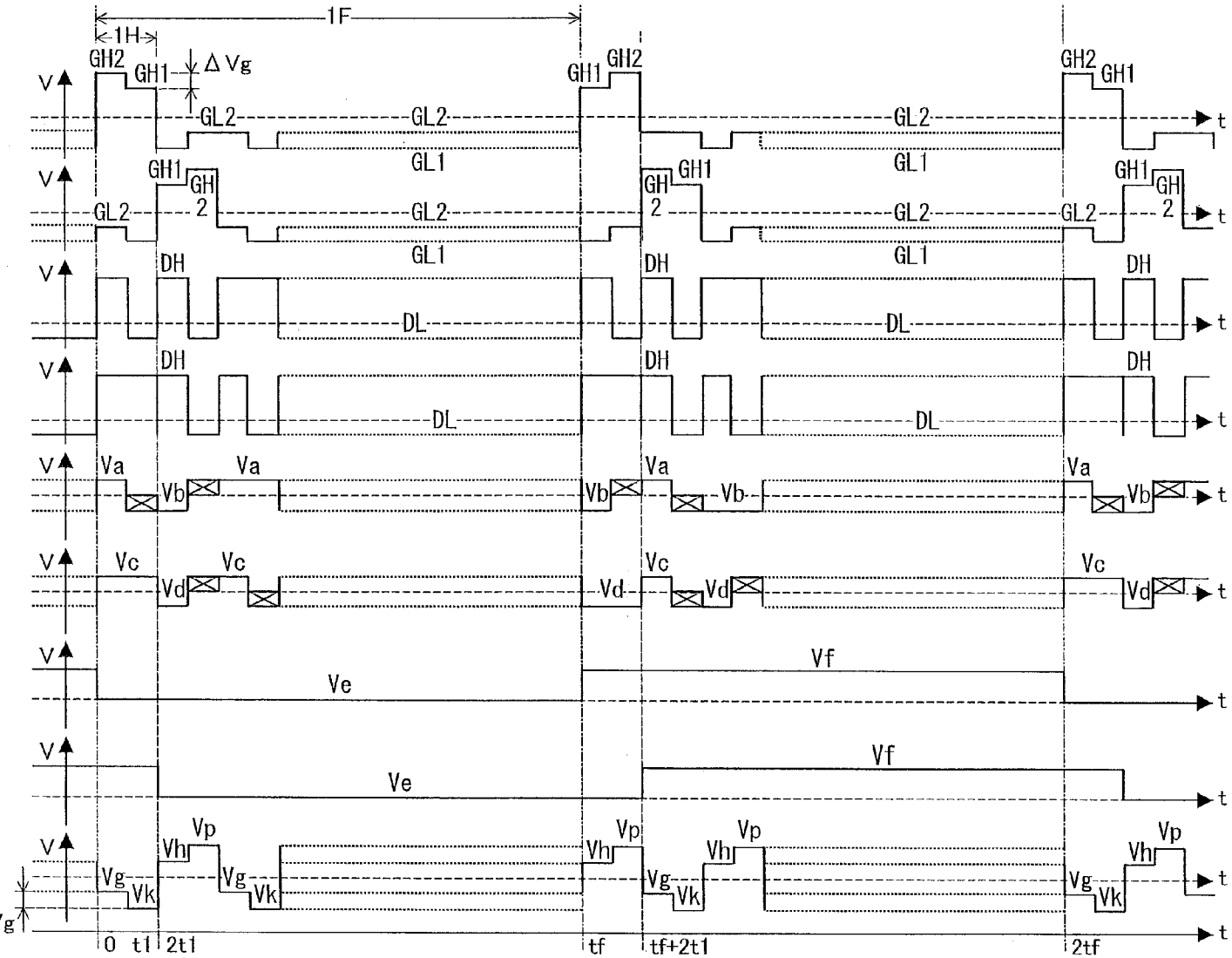
FIG. 15 is a timing chart showing a first operation performed by the third display device when display data is written to pixels included in the third display device of FIG. 14.

As shown in 5) and 6) of FIG. 15, the timing at which signal voltages are fed into the source lines Sj and Sj+1 respectively is the same as in Embodiment 2.

As shown in 3) and 4) of FIG. 15, the timing at which signals are outputted from the OR circuits 34 of the source driver circuit 18 is the same as in Embodiment 2.

As shown in 7) and 8) of FIG. 15, the timing at which potentials are fed into the auxiliary capacitance lines Ui and Ui+1 is the same as in Embodiment 2.

In addition, the counter electrode com of the pixel Aij (2) shown in FIG. 10 is fed with a potential shown in 9) of FIG. 15 from a switching circuit (not shown) in the same manner as in Embodiment 2.

Meanwhile, as shown in 1) and 2) of FIG. 15, selection potentials fed into the gate lines Gi and Gi+1 respectively are different from the selection potential in Embodiment 2. This is because the logic circuit/buffer 38 of the gate driver circuit 37 is different from the logic circuit/buffer 32 of Embodiment 2.

The gate driver circuit 37 of the present embodiment obtains a logical product (AND) of a start pulse Y1 sent through the shift register 31 and an externally fed control signal YOE as in Embodiment 2. However, the present embodiment and Embodiment 2 are different when the output to the gate line Gi is further controlled by the control signal HP. In Embodiment 2, an output of the logic circuit/buffer 32 which is connected with the gate line Gi is set in a high impedance state when the control signal HP is in a low state. In the present embodiment, when the control signal HP is in the low state, the gate driver circuit 37 selects a potential to be fed into the gate line Gi which potential is different from a potential fed when the control signal HP is high.

The potential controlled as above is fed into each of the gate lines Gi and Gi+1 from the gate driver circuit 37, as shown in 1) and 2) of FIG. 15.

With reference to a timing chart of FIG. 15, the following description deals with how the display device 36 operates when display data is written to the Aij (2) of the present embodiment.

In FIG. 15, the period from time 0 to time t1 is a first period of a first frame. During this period, the gate line Gi is fed with a potential GH1 (selection potential), while the other gate line Gk (where k≠i) is fed with a potential GL2 (non-selection potential). This sets a TFT:Q1 which corresponds to a pixel connected with the gate line Gi in an ON state, and also sets a TFT:Q1 which corresponds to a pixel connected with the gate line Gk in an OFF state.

During this period, video data Dxij is fed, for example as a potential Va, from a corresponding one of the D/A converter circuits 33 into the source line Sj. In addition, video data Dxij+1 is fed, for example as a potential Vc, into the source line Sj+1.

The potential of the counter electrode com is set to Vg during this period.

The period from time t1 to time 2*t*1 is a second period of the first frame. During this period, the control signal HP is set on low. Further, during this period, when the most significant bit (J5) in the video data Dxij is in a high state, the transistor Q3 is set in the ON state and the video data Dxij is thereby fed from the D/A converter circuit 33 into the source line Sj+1 in the output circuit 20 shown in FIG. 14.

In contrast, when the most significant bit (J5) in the video data Dxij is in a low state, the transistor Q3 is set in the OFF state and the source line Sj and the corresponding output circuit 20 are set in an open-circuit state with respect to each other.

The potential Vg of the counter electrode com is changed by the amount of a voltage ΔVg, into a potential Vk.

Accordingly, the potential of the gate line Gi is also changed by the amount of the voltage ΔVg into a potential GH1. In addition, the potential of the gate line Gk is also changed by the amount of the voltage ΔVg into a potential GL1.

This causes the potential of the source line Sj in the open-circuit state with respect to each other to be influenced by the change of the voltage ΔVg via the stray capacitance between the source line Sj and the gate lines Gi and Gk. Therefore, the potential is changed by the amount of the voltage ΔVg into Va−ΔVg. This causes the potential difference between the pixel electrode 35 and the counter electrode corn to remain at Va-Vg.

The potential Vc is maintained in the source line Sj+1 connected with a corresponding one of the D/A converter circuits 33 because the source line Sj+1 is fed with an electric charge from the source driver circuit 18. Consequently, the potential difference between the pixel electrode 35 and the counter electrode corn is set to Vc−Vk.

When Va=0V, Vc=2V, Vg=−1V, and Vk=−2V, the amplitude of a voltage applied to the pixel electrode 35 is as follows:

$$Va-Vg=1\text{V}$$

$$Vc-Vk=4\text{V}$$

This voltage amplitude results from the addition of the change ΔVg in the voltage of the counter electrode corn to the 2V amplitude of a voltage from the corresponding D/A converter circuit 33.

As described above, the present embodiment also allows realizing a display device in which the factors for a high cost and an increase in power consumption are suppressed, and in which the effective value of a voltage applied to the liquid crystal element LC can have a variance larger than the amplitude of a signal voltage fed into the source line Sj, the variance corresponding to the variation in the signal voltage.

In a case where the voltage in the gate lines is unchanged, additional lines which form capacity coupling with the source lines may be provided so that the voltage in the additional lines can be changed instead.

Figure 16:
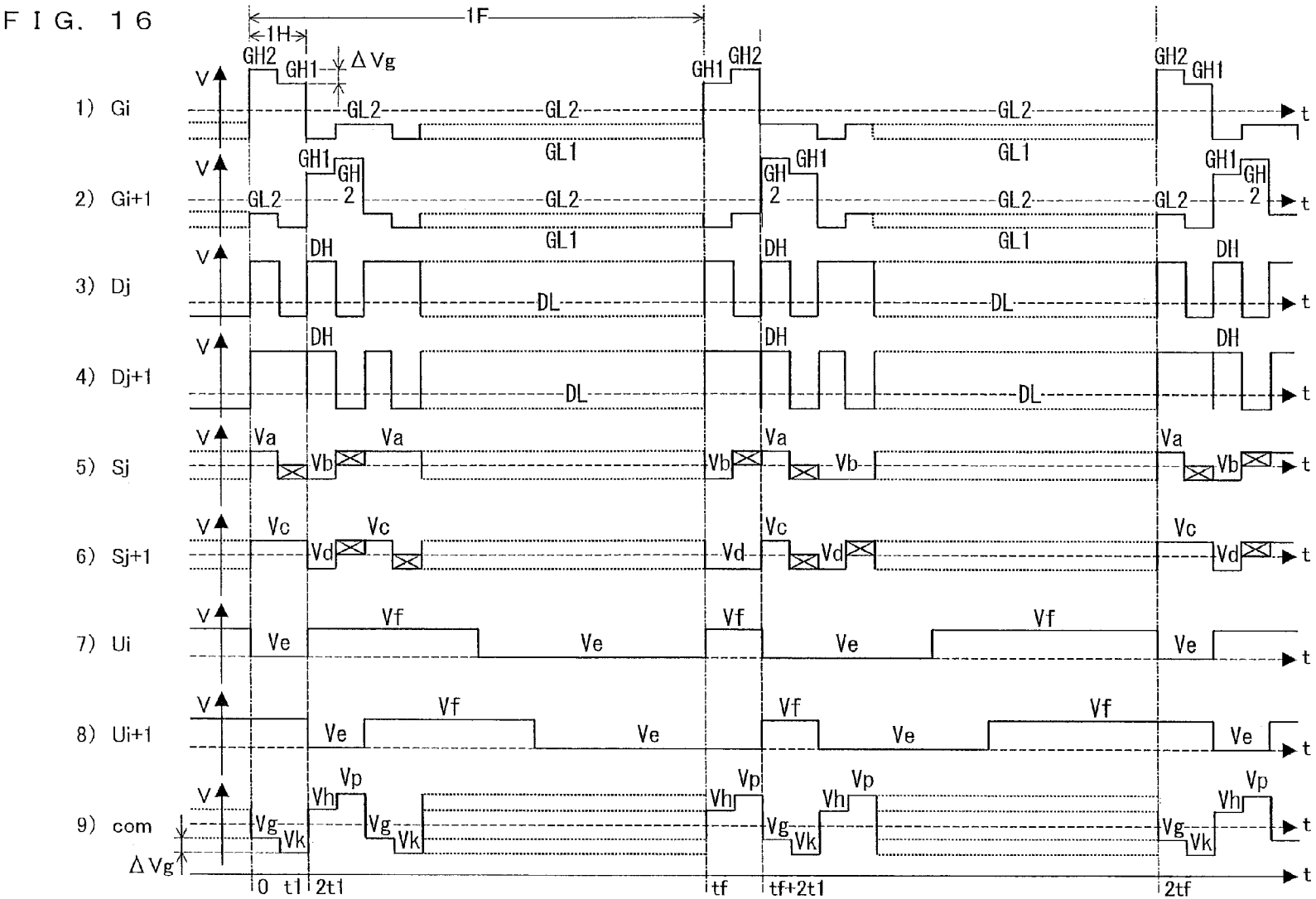
FIG. 16 is a timing chart showing a second operation performed by the third display device when display data is written to the pixels included in the third display device of FIG. 14.
Figure 17:
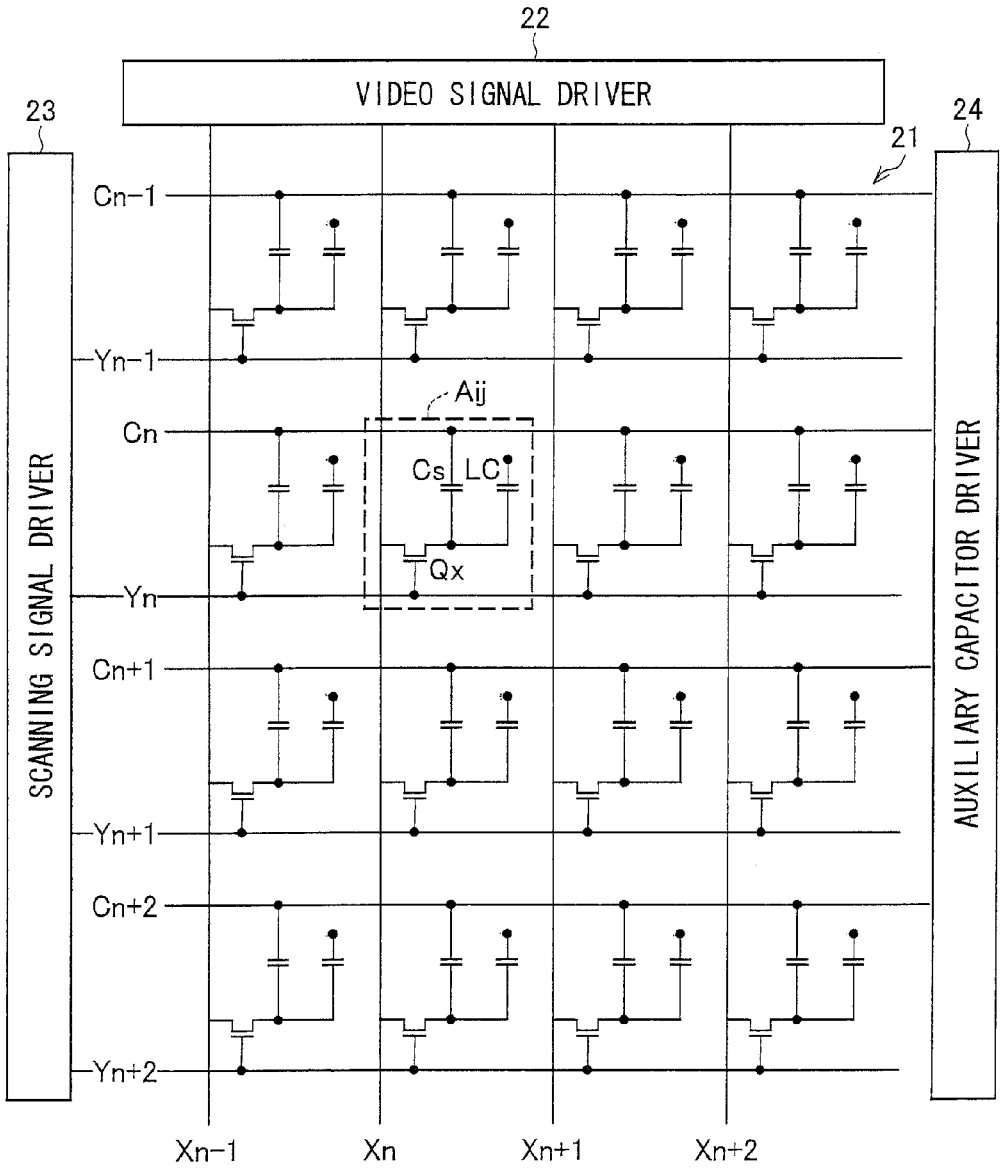
FIG. 17 PRIOR ART
FIG. 17 is a circuit block diagram showing an arrangement of a display device using a conventional art.
Figure 18:
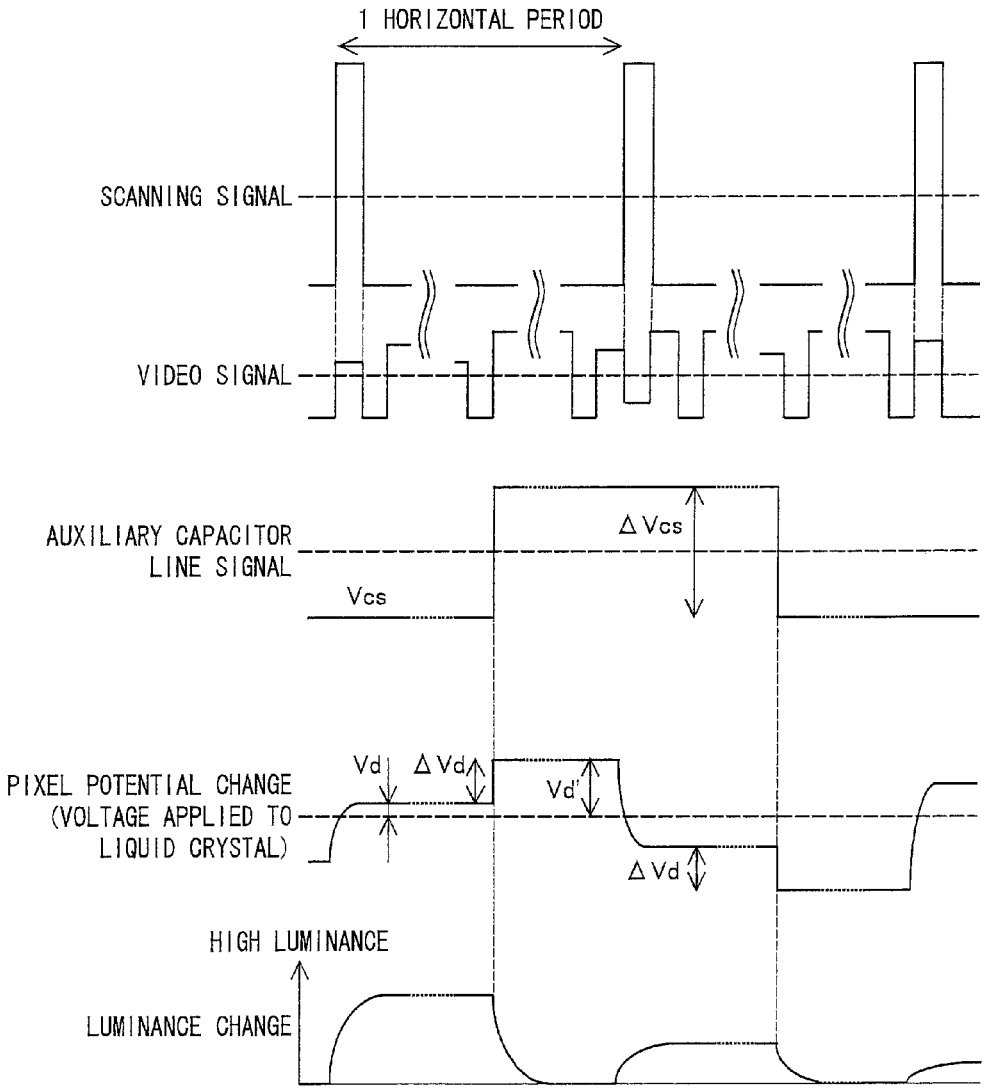
FIG. 18 PRIOR ART
FIG. 18 is a timing chart showing an operation performed by the display device of FIG. 17.
Figure 19:
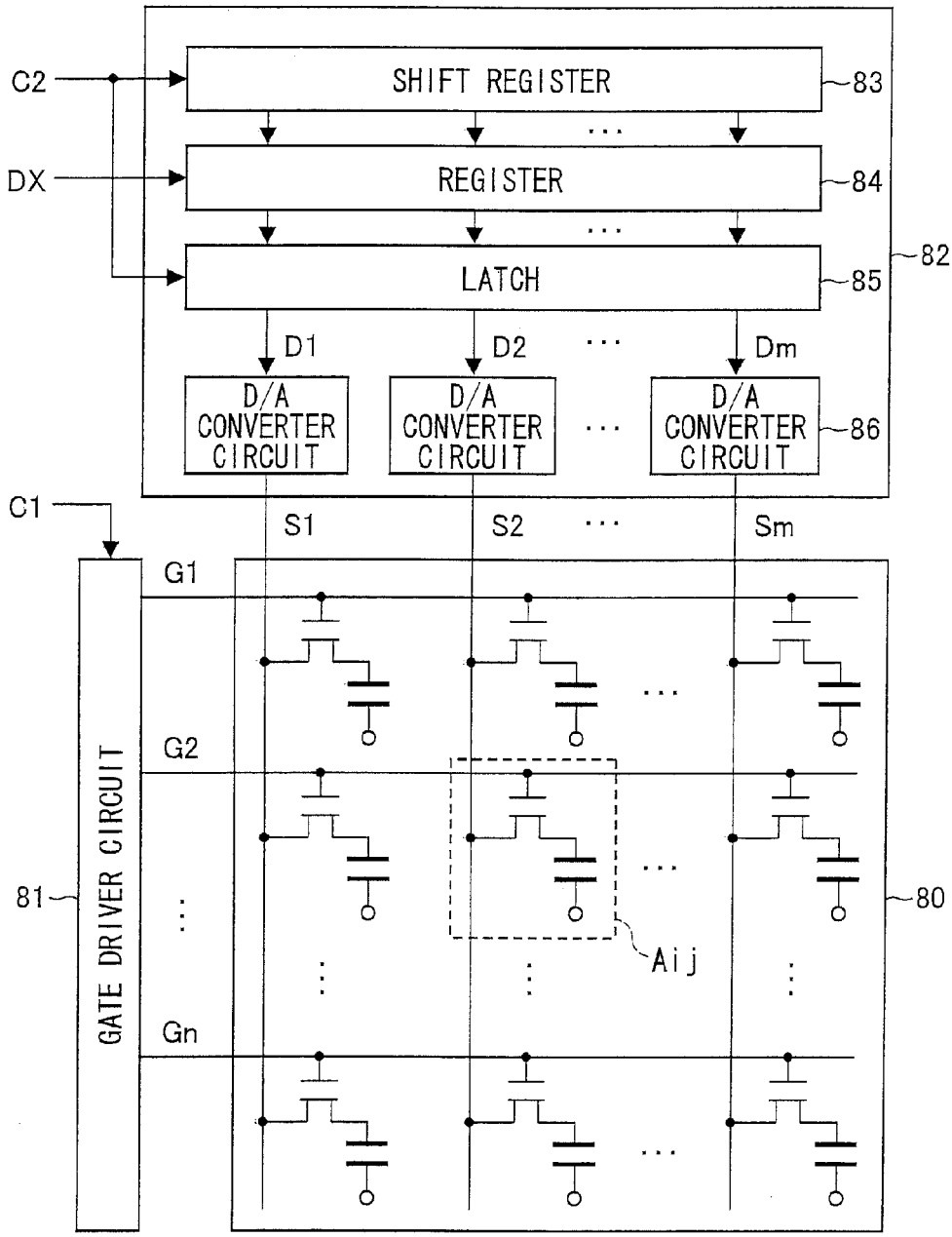
F I G. 1 9 PRIOR ART
FIG. 19 is a circuit block diagram showing an arrangement of a display device using a conventional art.
Figure 20:
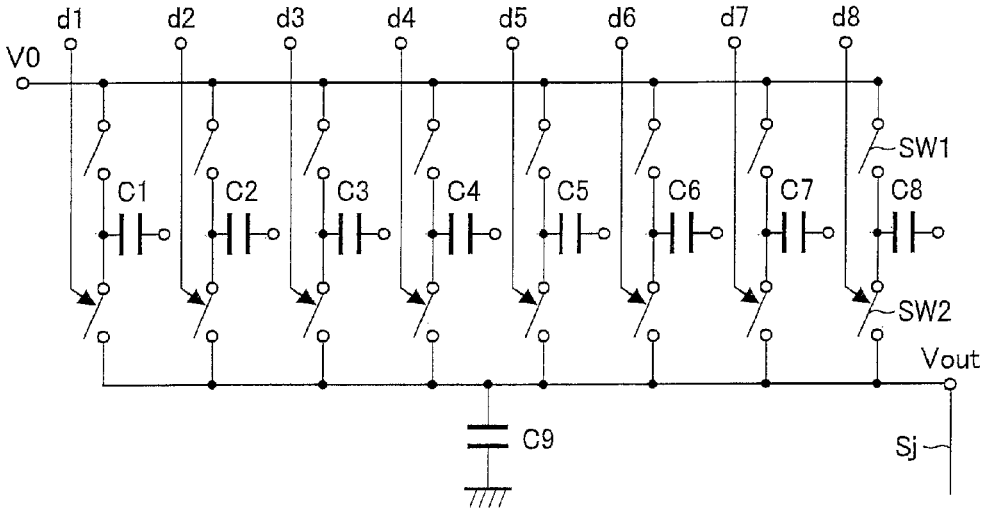
FIG. 20 PRIOR ART
FIG. 20 is a circuit diagram showing a first arrangement of a D/A converter circuit included in the display device of FIG. 20.
Figure 21:
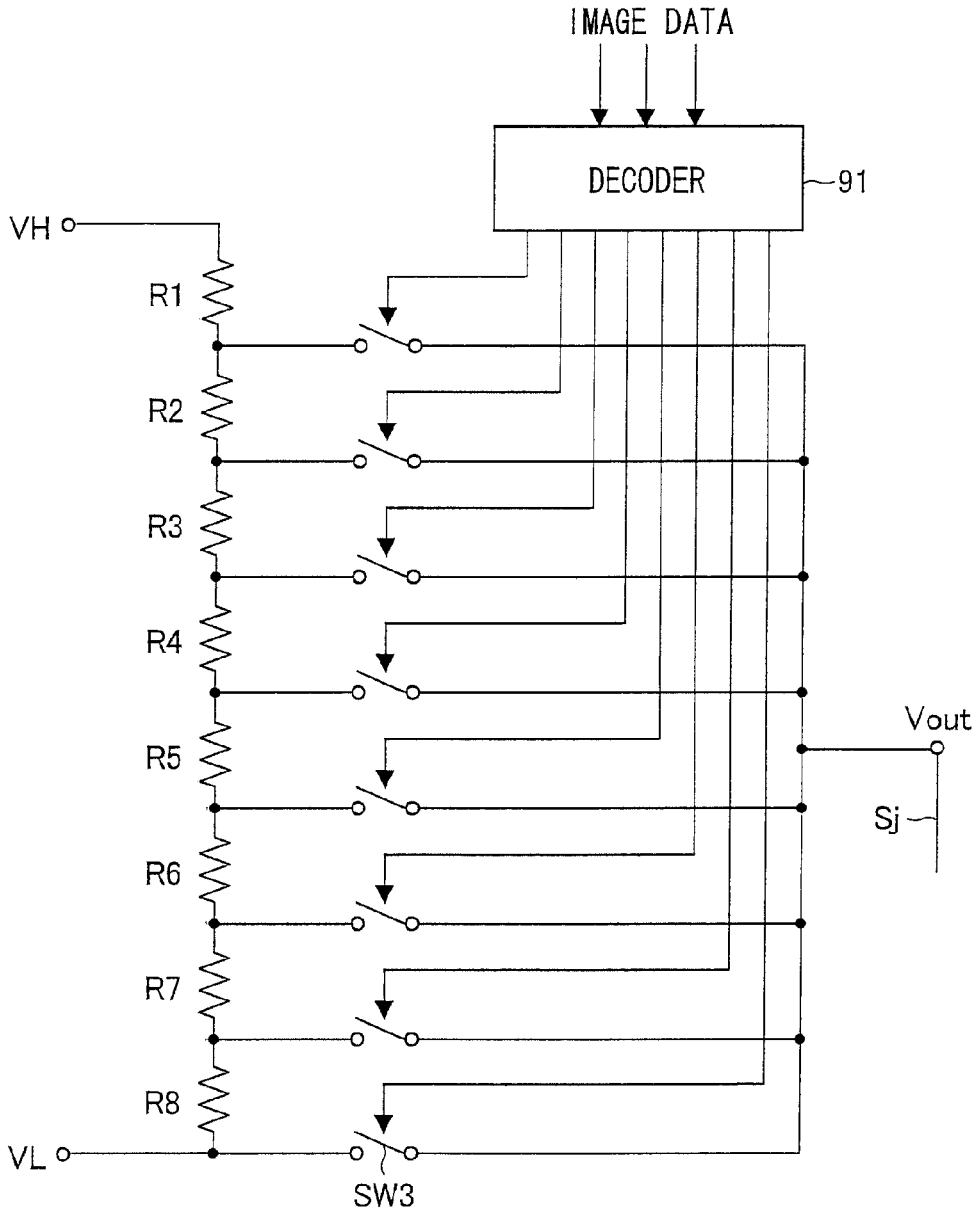
FIG. 21 PRIOR ART
FIG. 21 is a circuit diagram showing a second arrangement of a D/A converter circuit included in the display device of FIG. 20.
Figure 22:
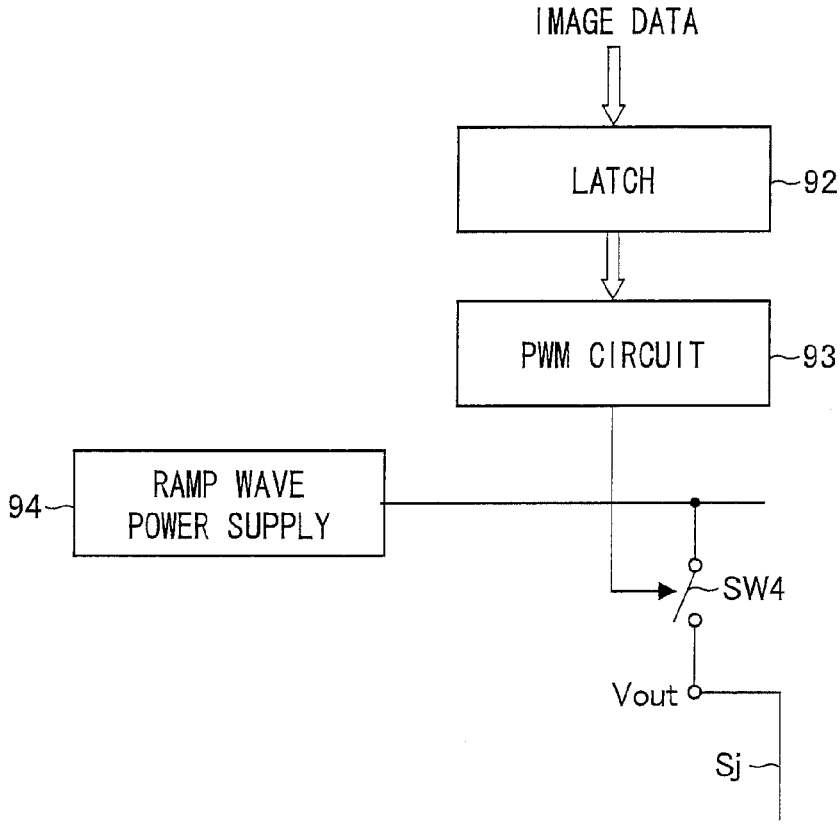
F I G. 2 2 PRIOR ART
FIG. 22 is a circuit diagram showing a third arrangement of a D/A converter circuit included in the display device of FIG. 20.
Figure 23:
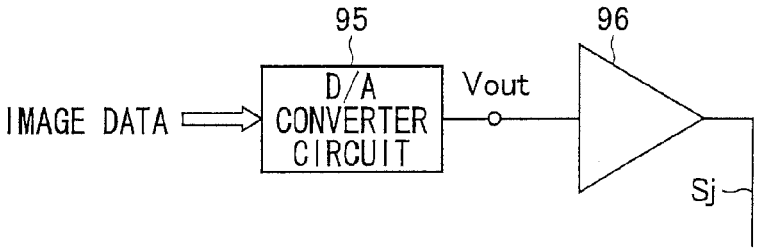
F I G. 2 3 PRIOR ART
FIG. 23 is a circuit diagram showing an arrangement in which an analog buffer is connected with an output of a D/A converter circuit.

Since it is possible to increase the amplitude of the on/off voltage applied to the liquid crystal element LC as described above, the potential of the auxiliary capacitance line Ui can be changed, in the present embodiment as well, within one frame period as shown in FIG. 16 to the extent of the increase in the voltage amplitude, with anticipation that the amplitude of the on/off voltage will be attenuated. As shown in FIG. 16, the potential of the auxiliary capacitance line Ui during the first half of the third period is set to the potential Vf which is different from the potential Ve in the second half of the third period.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

As described above, a first display device of the present invention includes pixels provided so as to correspond to intersections of scanning signal lines and data signal lines, wherein: the pixels each includes: an electrooptic element having a driving potential input terminal to receive a potential for driving the electrooptic element; a first switching element between the driving potential input terminal of the electrooptic element and that one of the data signal lines which corresponds to the pixel; a first capacitor element whose first terminal is connected with the driving potential input terminal of the electrooptic element; a second capacitor element having a first terminal connected with the second terminal of the first capacitor element; and a second switching element disposed between (i) the one of the data signal lines and (ii) a node between the second terminal of the first capacitor element and the first terminal of the second capacitor element, the scanning signal lines includes: first scanning signal lines each connected with a conduction control terminal of the first switching element; and second scanning signal lines each connected with a conduction control terminal of the second switching element, the first scanning signal lines and the second scanning signal lines being paired in correspondence with the individual pixels, and the display device comprises potential lines connected with the second terminals of the second capacitor elements, respectively.

The above allows realizing a display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

As described above, a second display device of the present invention includes pixels provided so as to correspond to intersections of scanning signal lines and the data signal lines, wherein: the pixels each includes: an electrooptic element having a driving potential input terminal to receive a potential for driving the electrooptic element; a first switching element between the driving potential input terminal of the electrooptic element and that one of the data signal lines which corresponds to the pixel, the first switching element having a conduction control terminal connected with one of the scanning signal lines, the outputs of the data signal line driving circuit being capable of being selectively set in a high impedance state, depending on the data signal lines.

The above allows realizing a display device in which the factors for a high cost and an increase in power consumption are suppressed, and in which the effective value of a voltage expressed by the difference between (i) a potential applied to the driving potential input terminal of an electrooptic element and (ii) a reference potential can have a variance larger than the amplitude of a signal voltage fed into a data signal line, the variance corresponding to the variation in the signal voltage.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is preferably applicable to liquid crystal display devices and EL display devices in particular.

The invention claimed is:

1. A display device comprising pixels provided so as to correspond to intersections of scanning signal lines and data signal lines, wherein:

the pixels each includes:

an electrooptic element having a driving potential input terminal to receive a potential for driving the electrooptic element;

a first switching element between the driving potential input terminal of the electrooptic element and that one of the data signal lines which corresponds to the pixel;

a first capacitor element whose first terminal is connected with the driving potential input terminal of the electrooptic element;

a second capacitor element having a first terminal connected with the second terminal of the first capacitor element; and a second switching element disposed between (i) the one of the data signal lines and (ii) a node between the second terminal of the first capacitor element and the first terminal of the second capacitor element, the scanning signal lines includes:

first scanning signal lines each connected with a conduction control terminal of the first switching element; and second scanning signal lines each connected with a conduction control terminal of the second switching element, the first scanning signal lines and the second scanning signal lines being paired in correspondence with the individual pixels, and the display device comprises potential lines connected with the second terminals of the second capacitor elements, respectively.

2. The display device according to claim 1, wherein: when display data is written to a target pixel among the pixels, the target pixel is driven through:

a first period, during which the first switching element is in a conductive state and the second switching element is in a non-conductive state respectively;

a second period, during which the first switching element is in in the non-conductive state, and the second switching element is in the conductive state respectively; and a third period, during which the first switching element and the second switching element are both in the non-conductive state.

3. The display device according to claim 2, wherein the potential line is changed in potential in the third period.

4. The display device according to claim 3, the pixels each further including a pixel electrode, wherein the electrooptic element is a liquid crystal element, and the driving potential input terminal is a terminal of the liquid crystal element, the terminal being connected with the pixel electrode.

5. The display device according to claim 3, wherein the electrooptic element is an element including:

an organic electroluminescence element; and a driver thin film transistor for driving the organic electroluminescence element, and the driving potential input terminal is a gate terminal of the driver thin film transistor.

6. The display device according to claim 2, the pixels each further including a pixel electrode, wherein the electrooptic element is a liquid crystal element, and the driving potential input terminal is a terminal of the liquid crystal element, the terminal being connected with the pixel electrode.

7. The display device according to 2, wherein the electrooptic element is an element including:

an organic electroluminescence element; and a driver thin film transistor for driving the organic electroluminescence element, and the driving potential input terminal is a gate terminal of the driver thin film transistor.

8. The display device according to claim 1, the pixels each further including a pixel electrode, wherein the electrooptic element is a liquid crystal element, and the driving potential input terminal is a terminal of the liquid crystal element, the terminal being connected with the pixel electrode.

9. The display device according to claim 1, wherein the electrooptic element is an element including:

an organic electroluminescence element; and a driver thin film transistor for driving the organic electroluminescence element, and the driving potential input terminal is a gate terminal of the driver thin film transistor.

10. The display device according to claim 1, wherein the first switching element and the second switching element are thin film transistors, and the respective conduction control terminals of the first switching element and the second switching element are respective gate terminals of the thin film transistors.

11. A display device comprising pixels provided so as to correspond to intersections of scanning signal lines and data signal lines, wherein:

the pixels each include:

an electrooptic element having a driving potential input terminal to receive a potential for driving the electrooptic element; and a first switching element between the driving potential input terminal of the electrooptic element and that one of the data signal lines which corresponds to the pixel, the first switching element having a conduction control terminal connected with one of the scanning signal lines, outputs of a data signal line driving circuit being capable of being selectively set in a high impedance state, depending on the data signal lines, wherein, when display data is written to a target pixel among the pixels, the target pixel is driven through, a first period, during which the first switching element is set in a conductive state, and the data signal line driving circuit feeds, to the data signal line, a potential corresponding to the display data for the target pixel;

a second period, during which the first switching element is set in the conductive state, the data signal lines include selected data signal lines and remaining data signal lines, the data signal line driving circuit feeds the selected data signal lines with outputs in a high impedance state respectively, the data signal line driving circuit feeds the remaining data signal lines with respective potentials corresponding to the display data, and, in a case where a capacitance is formed between a counter electrode and the driving potential input terminal of the electrooptic element, a potential of the counter electrode is changed, or a potential of the scanning signal lines other than the scanning signal line connected to the target pixel is changed; and a third period, during which the first switching element is set in a non-conductive state.

12. A display device comprising pixels provided so as to correspond to intersections of scanning signal lines and data signal lines, wherein:

the pixels each include:

an electrooptic element having a driving potential input terminal to receive a potential for driving the electrooptic element; and a first switching element between the driving potential input terminal of the electrooptic element and that one of the data signal lines which corresponds to the pixel, the first switching element having a conduction control terminal connected with one of the scanning signal lines, outputs of a data signal line driving circuit being capable of being selectively set in a high impedance state, depending on the data signal lines, wherein the display device further comprises potential lines, the pixels each further including a first capacitor element having, a first terminal connected with the driving potential input terminal of the electrooptic element; and a second terminal connected with one of the potential lines and wherein, when display data is written to a target pixel among the pixels, the target pixel is driven through, a first period, during which the first switching element is set in a conductive state, and the data signal line driving circuit feeds, to the data signal line, a potential corresponding to the display data for the target pixel;

a second period, during which the first switching element is set in the conductive state, the data signal lines include selected data signal lines and remaining data signal lines, the data signal line driving circuit feeds the selected data signal lines with outputs in a high impedance state respectively, the data signal line driving circuit feeds the remaining data signal lines with potentials corresponding to the display data; and a third period, during which the first switching element is set in a non-conductive state, and the potential line is changed in potential.

* * * * *